US011898321B2

(12) United States Patent
Kalantar et al.

(10) Patent No.: US 11,898,321 B2
(45) Date of Patent: Feb. 13, 2024

(54) INPUT SHAPING FOR ERROR DETECTION AND RECOVERY IN DYNAMICALLY AGILE GRADING MACHINES

(71) Applicant: Topcon Positioning Systems, Inc., Livermore, CA (US)

(72) Inventors: Shahab Kalantar, Brisbane (AU); Dmytro Poplavskiy, Wishart (AU)

(73) Assignee: Topcon Positioning Systems, Inc., Livermore, CA (US)

( * ) Notice: Subject to any disclaimer, the term of this patent is extended or adjusted under 35 U.S.C. 154(b) by 561 days.

(21) Appl. No.: 17/125,967

(22) Filed: Dec. 17, 2020

(65) Prior Publication Data

US 2022/0195693 A1 Jun. 23, 2022

(51) Int. Cl.
*E02F 3/84* (2006.01)

(52) U.S. Cl.
CPC ..... *E02F 3/845* (2013.01); *E02F 3/847* (2013.01)

(58) Field of Classification Search
CPC . E02F 3/845; E02F 3/847; E02F 3/841; E02F 9/265
See application file for complete search history.

(56) References Cited

U.S. PATENT DOCUMENTS 6,904,979 B1 * 6/2005 Confoey ..... E02F 3/7604 172/799.5
2013/0277943 A1 * 10/2013 Wendte ..... B60D 1/363 280/421
2014/0019015 A1 1/2014 Claxton
2014/0343800 A1 * 11/2014 Nelson ..... E02F 3/845 701/49
2018/0038068 A1 2/2018 Hashimoto et al.
2019/0218747 A1 * 7/2019 Hashimoto ..... G05D 1/02
2019/0234045 A1 8/2019 Wiewel et al.
2020/0105072 A1 * 4/2020 Wisley ..... G05D 1/024
2021/0340735 A1 * 11/2021 Veasy ..... E02F 3/7627
2022/0151133 A1 * 5/2022 Mckinzie ..... A01B 63/24

FOREIGN PATENT DOCUMENTS

EP 2586918 A2 5/2013
EP 3660231 A1 6/2020

OTHER PUBLICATIONS

International Search Report and Written Opinion dated Feb. 10, 2022, in connection with International Patent Application No. PCT/US2021/071792, filed Oct. 8, 2021, 14 pgs.

* cited by examiner

*Primary Examiner* — Russell Frejd
(74) *Attorney, Agent, or Firm* — Chiesa Shahinian & Giantomasi PC

(57) ABSTRACT

Systems and methods for adjusting a height of an implement mounted on a body of a vehicle as the vehicle travels over a terrain are provided. Sensor data is received from a set of sensors disposed on the vehicle. A trajectory associated with the vehicle is determined based on the received sensor data. A profile of the terrain is estimated based on the determined trajectory associated with the vehicle. A ditch is detected in the terrain and compensation values for adjusting the height of the implement are determined based on the estimated profile of the terrain to compensate for the detected ditch. One or more control signals are transmitted to one or more actuators for adjusting the height of the implement based on the determined compensation values.

28 Claims, 15 Drawing Sheets

INPUT SHAPING FOR ERROR DETECTION AND RECOVERY IN DYNAMICALLY AGILE GRADING MACHINES

TECHNICAL FIELD

The present invention relates generally to a control system for adjusting the height of an implement of a vehicle, and more particularly to input shaping for error detection and recovery in dynamically agile grading machines.

BACKGROUND

Grading is the process of manipulating the surface of terrain to achieve a target terrain surface. Grading is an important process in many different applications. For example, in construction, grading may be performed to set a foundation of a building. In agriculture, grading may be performed to direct surface water runoff. Dozing machines are typically used for grading terrain. A dozing machine comprises a body and a blade coupled to the body. In operation, as the dozing machine travels over the terrain, the height of the blade is adjusted to manipulate the surface of the terrain to achieve the target terrain surface.

Conventional control systems may be implemented in dozing machines for automatically adjusting the height of the blade to compensate for disturbances to the dozing machine as the dozing machine experiences the disturbances. However, conventional control systems have an inherent response delay time (e.g., approximately 100-300 milliseconds), which prevents the height of the blade from being timely adjusted to compensate for some disturbance. For example, the terrain typically includes many disturbances such as ditches. As the dozing machine travels over the terrain, a ditch will cause the dozing machine to pitch forward, thereby lowering the blade. Since conventional control systems are not able to timely adjust the height of the blade, the lowered blade will result in the creation of another ditch. The dozing machine will then travel over the created ditch, thereby creating another larger ditch. This problem will perpetuate as the dozing machine continues to travel over the terrain, resulting in instability and oscillations in the graded terrain.

SUMMARY

In accordance with one or more embodiments, systems and methods for adjusting a height of an implement mounted on a body of a vehicle as the vehicle travels over a terrain are provided. Sensor data is received from a set of sensors disposed on the vehicle. A trajectory associated with the vehicle is determined based on the received sensor data. A profile of the terrain is estimated based on the determined trajectory associated with the vehicle. A ditch is detected in the terrain and compensation values for adjusting the height of the implement are determined based on the estimated profile of the terrain to compensate for the detected ditch. One or more control signals are transmitted to one or more actuators for adjusting the height of the implement based on the determined compensation values. The vehicle may be a dozer machine and the implement of the vehicle may be a blade.

In one embodiment, the trajectory associated with the vehicle is determined by determining a state of the body and a state of the implement based on the received sensor data, mapping the state of the body and the state of the implement to a one dimensional space to determine a state of the vehicle, and determining the trajectory associated with the vehicle based on the state of the vehicle. The state of the body and the state of the implement may be determined as a position and an orientation of the body and the implement and a linear velocity and an angular velocity associated with each axis of the position and the orientation of the body and the implement.

In one embodiment, the profile of the terrain is estimated by determining a pitch associated with the body based on the determined trajectory associated with the vehicle.

In one embodiment, the ditch is detected by computing a first derivative of the estimated profile of the terrain, determining that the first derivative of the estimated profile of the terrain for a current point is a zero crossing, and comparing a magnitude of the estimated profile of the terrain for the current point to a magnitude of the estimated profile of the terrain for a last point determined to be a zero crossing. The compensation values may be determined by determining a range of points between the current point and a last point determined to be a hump in the estimated profile of the terrain and determining the compensation value for each point in the range of points based on a shape characteristic and a differential magnitude of the estimated profile of the terrain at the current point and the last point determined to be the hump. The shape characteristic may include a step shape characteristic, a logarithmic shape characteristic, a quadratic shape characteristic, a ramp shape characteristic, an exponential shape characteristic, or a combination thereof.

In one embodiment, the one or more control signals are transmitted by combining initial error values for achieving a target terrain surface with the determined compensation values to generate final error values and generating the one or more control signals for adjusting the height of the implement according to the final error values.

These and other advantages of the invention will be apparent to those of ordinary skill in the art by reference to the following detailed description and the accompanying drawings.

DETAILED DESCRIPTION

Figure 1:
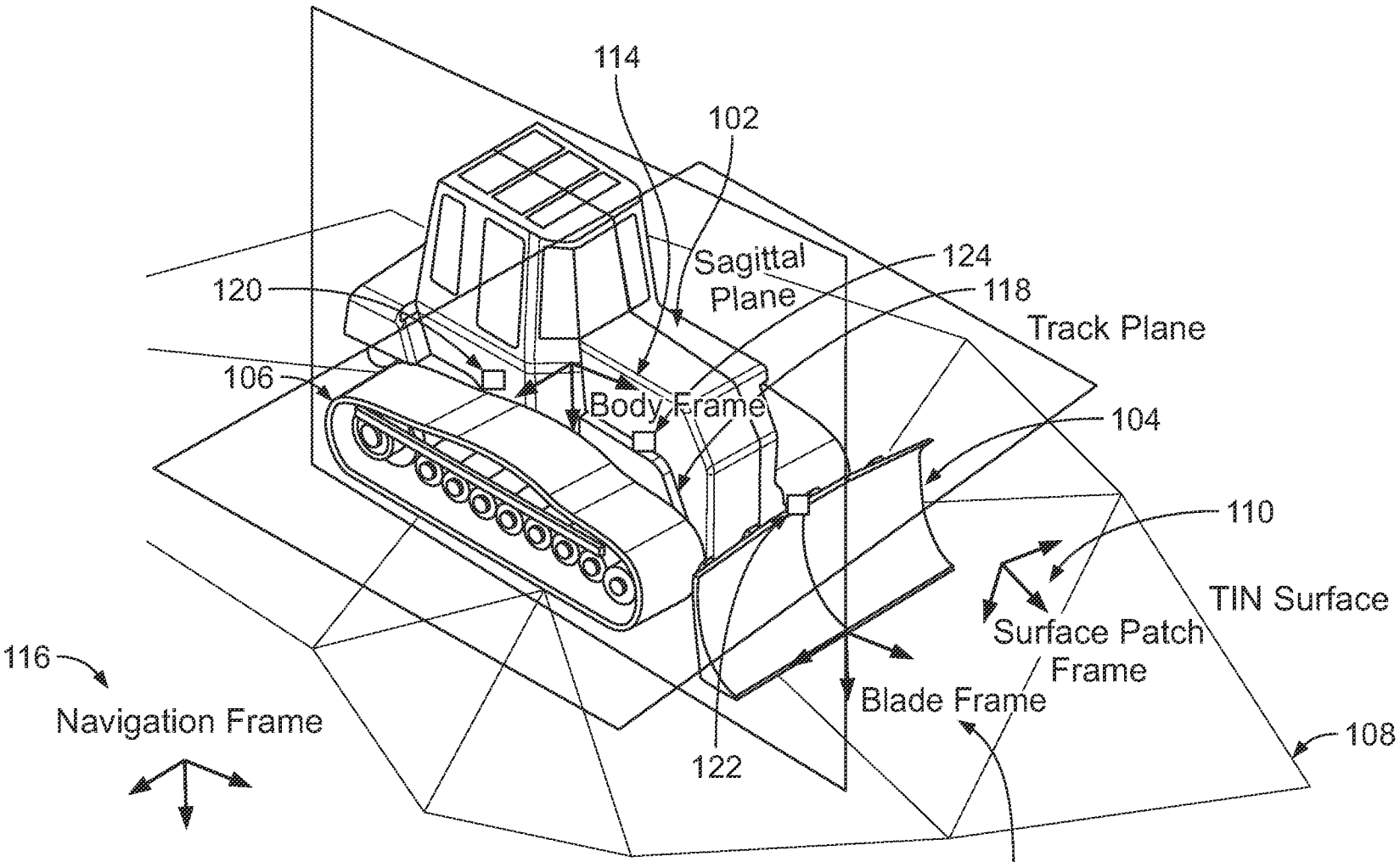
FIG. 1 shows an exemplary dozing machine, in accordance with one or more embodiments.

Referring to FIG. 1, an exemplary dozing machine 100 is shown, in accordance with one or more embodiments. Dozing machine 100 includes a body 102 and a blade 104 (or other suitable implement) pivotably coupled to body 102 via a boom arm (not shown). Dozing machine 100 also includes tracks 106 for travelling over a terrain 108 and may be operated autonomously or manually by an operator. Generally, in operation, dozing machine 100 may be utilized in a construction environment, agricultural environment, or any other environment to manipulate soil, sand, rubble, etc. on a surface of a terrain 108 via blade 104 to achieve a target terrain surface. As dozing machine 100 travels over terrain 108, dozing machine 100 may encounter various disturbances in the terrain 108. One example of such a disturbance is a ditch.

Dozing machine 100 operates in a 3D (three dimensional) environment and blade 104 has three degrees of freedom of rotational movement with respect to the body. Accordingly, the state of dozing machine 100 may be defined by the position of body 102 (in navigation frame 116), the orientation of body 102 (in navigation frame 116), and a relative orientation of blade 104 with respect to body 102 (in body frame 112). In one embodiment, the position is defined in (X, Y, Z) Cartesian coordinates and the orientation is defined in (yaw, pitch, roll) Euler angles. However, it should be understood that the position and the orientation may be represented in any suitable format. For example, the position may be represented as a 2D (two dimensional) curve lying on the surface of terrain 108 (which would require knowledge of terrain 108) and the orientation may be represented as rotation matrices, quaternions, etc.

A dozing machine may be implemented with a conventional control system for adjusting the height of the blade. However, conventional control systems have an inherent response delay time, which prevents such conventional control systems from timely adjusting the height of the blade to compensate for ditches and other such disturbances.

Embodiments described herein provide for a predictive control system to predict disturbances (e.g., due to a ditch) to body 102 due to disturbances in terrain 108 based on motion of blade 104. The predictive control system comprises a controller 120, a set of sensors 122 disposed on blade 104 and/or sensors 124 disposed on body 102, and one or more actuators 118 coupled to body 102 and blade 104. Controller 120 receives data from the set of sensors 122 and/or sensors 124 to predict disturbances to body 102 and generates control signals for controlling actuators 118 to adjust the height of blade 104 to compensate for the predicted disturbances. Advantageously, controller 120 predicts the disturbances on body 102, thereby providing sufficient time to adjust blade 104 for compensating for ditches and other such disturbances. For simplicity of exposition, the prediction of disturbances to body 102 due to disturbances in terrain 108 will first be described for a 2D environment with respect to FIGS. 2-4 before being described for a 3D environment.

Figure 2:
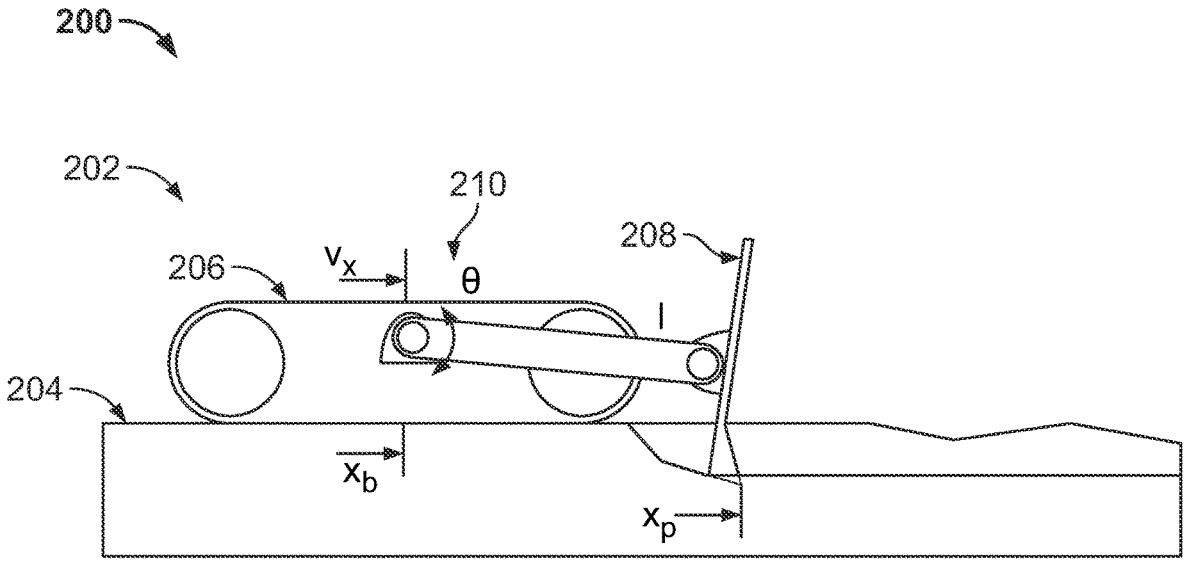
FIG. 2 shows an exemplary 2D environment in which a dozing machine operates, in accordance with one or more embodiments.

FIG. 2 shows an exemplary 2D environment 200 in which a dozing machine 202 operates, in accordance with one or more embodiments. Dozing machine 202 comprises body 206 and blade 208. In one example, dozing machine 202 may be dozing machine 100 of FIG. 1. As shown in FIG. 2, dozing machine 202 operates in 2D environment 200 to manipulate the surface of terrain 204. Body 206 of dozing machine 202 is parameterized by a height of body 206 and a pitch angle of body 206 with respect to a horizontal. Blade 208 of dozing machine 202 is parameterized by a blade pitch angle θ 210. The performance of dozing machine 202 is assessed by measuring the difference between the actual surface of terrain 204 and a target surface of terrain 204. Dozing machine 202 is implemented with one or more sensors, one or more actuators, and a controller for automatically adjusting a height of a blade 208, in accordance with one or more embodiments.

Figure 3:
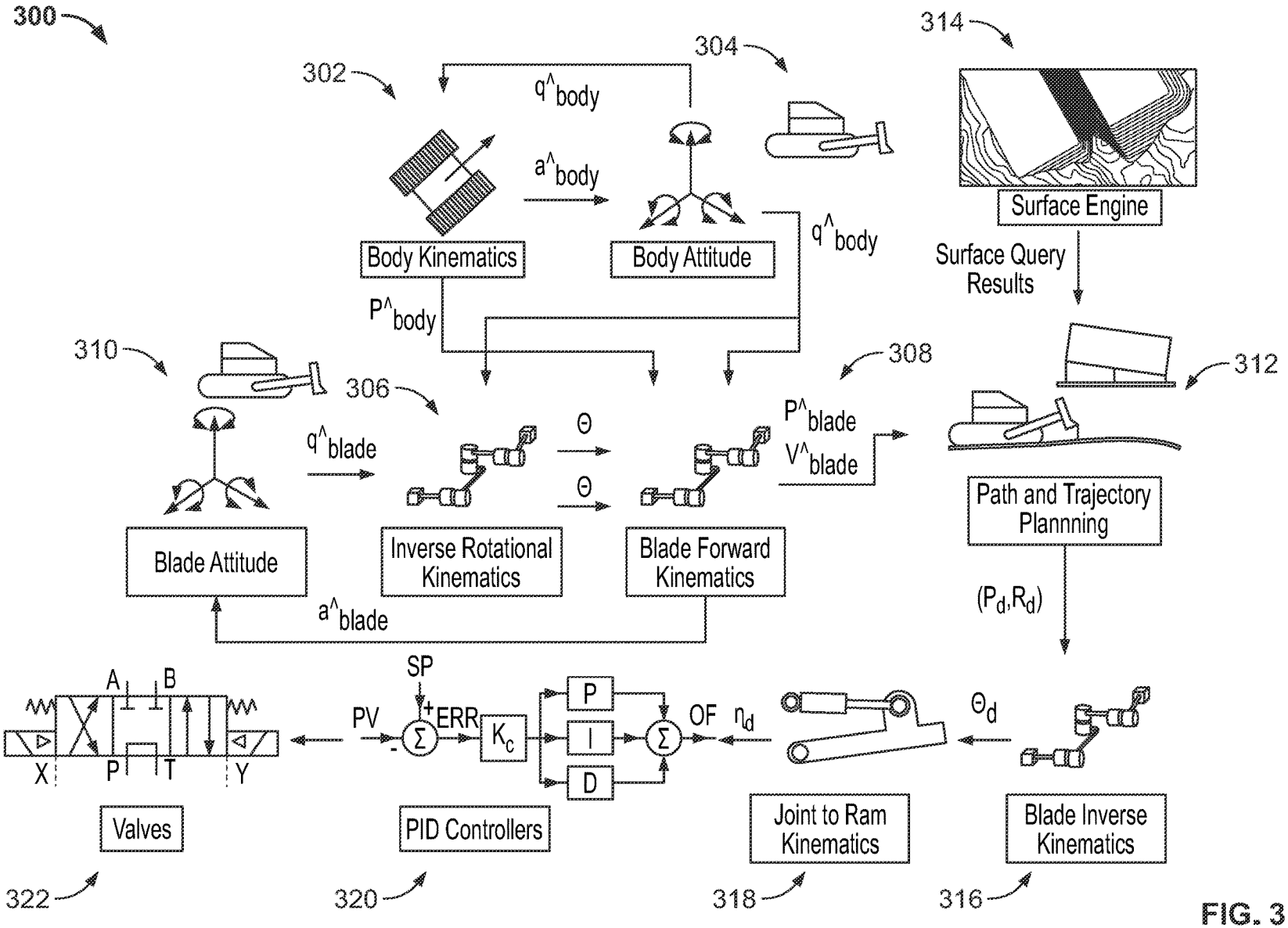
FIG. 3 shows a schematic diagram for a predictive control system for adjusting a height of a blade mounted on a body of a dozing machine for a 2D environment, in accordance with one or more embodiments.

FIG. 3 shows a schematic diagram 300 for a predictive control system for adjusting a height of a blade mounted on a body of a dozing machine for a 2D environment, in accordance with one or more embodiments. In one example, the dozing machine may be dozing machines 100 of FIG. 1 or dozing machine 202 of FIG. 2.

At block 304, body attitude (position) of the vehicle is determined based on a set of sensors mounted on the body of the vehicle. The set of sensors for determining the body attitude may comprise a position sensor for determining the (X, Y) Cartesian coordinates of the body of the vehicle. At block 302, body kinematics of the vehicle is determined based on the set of sensors mounted on the body of the vehicle and the body attitude (determined at step 304). In one example, the set of sensors for determining body kinematics may comprise an angular rotation sensor and an accelerometer. At block 308, blade forward kinematics is determined based on the body attitude, the body kinematics, and a set of sensors mounted on the blade of the vehicle. At block 310, blade attitude is determined based on the blade forward kinematics. At block 306, inverse rotational kinematics of the blade is determined based on the blade attitude and the body attitude. At block 312, path and trajectory planning is performed based on surface query results from surface engine 314. At block 316, blade inverse kinematics is determined based on the path and trajectory planning. At block 318, joint to ram kinematics is determined from the blade inverse kinematics. At block 320, the joint to ram kinematics is input into a controller (e.g., a proportional-integral-derivative controller), which outputs instructions to valves 322 for adjusting the height of the blade.

Figure 4:
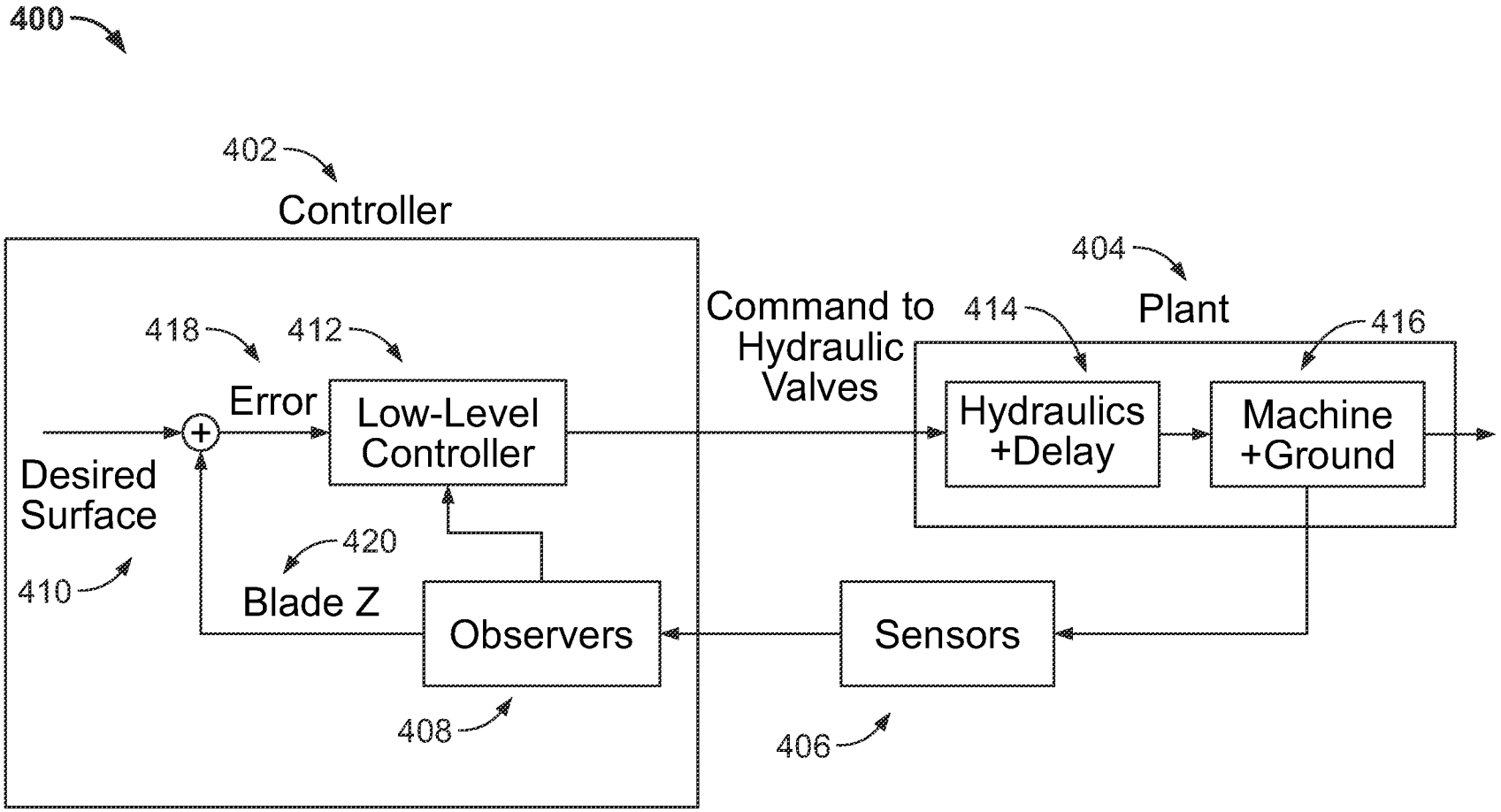
FIG. 4 shows a block diagram of a controller system for adjusting a height of a blade mounted on a body of a dozing machine for a 2D environment, in accordance with one or more embodiments.

FIG. 4 shows a block diagram of a controller system 400 for adjusting a height of a blade mounted on a body of a dozing machine for a 2D environment, in accordance with one or more embodiments. As shown in FIG. 4, controller system 400 comprises controller 402 and plant 404. Controller 402 receives data from sensors 406 mounted on the body and the blade of the dozing machine and estimates a state of the body and the blade by observers 408. Observers 408 generate compensation values (referred to as blade z) 420, which are combined with initial error values for generating the desired surface 410 to generate error 418. Error 418 is input into low-level controller 412, which sends commands to hydraulics and delay 414 for adjusting a height of the blade of machine to manipulate the ground 416.

Figure 5:
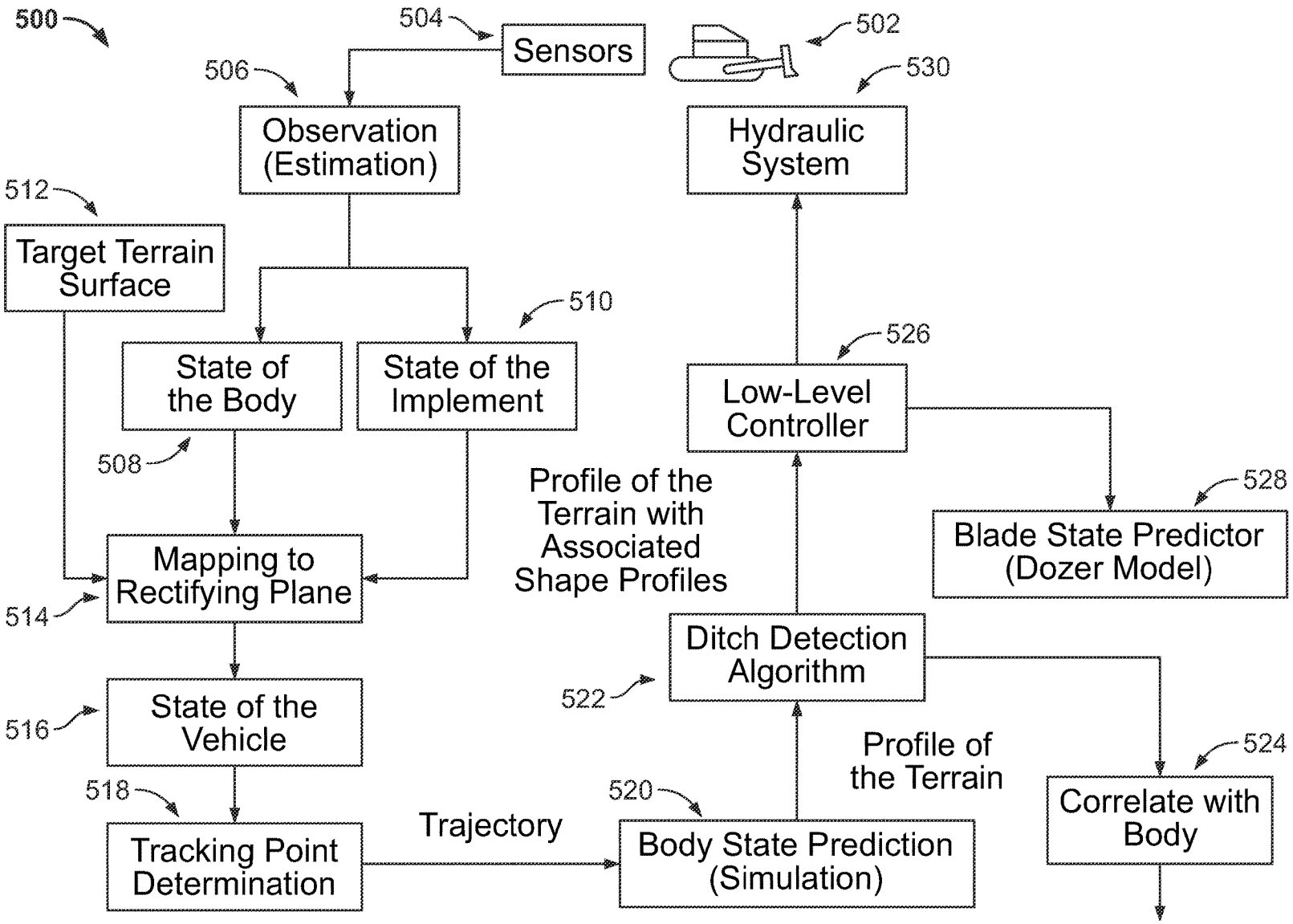
FIG. 5 shows a predictive control system for adjusting a height of an implement mounted on a body of a vehicle for a 3D environment, in accordance with one or more embodiments.
Figure 6:
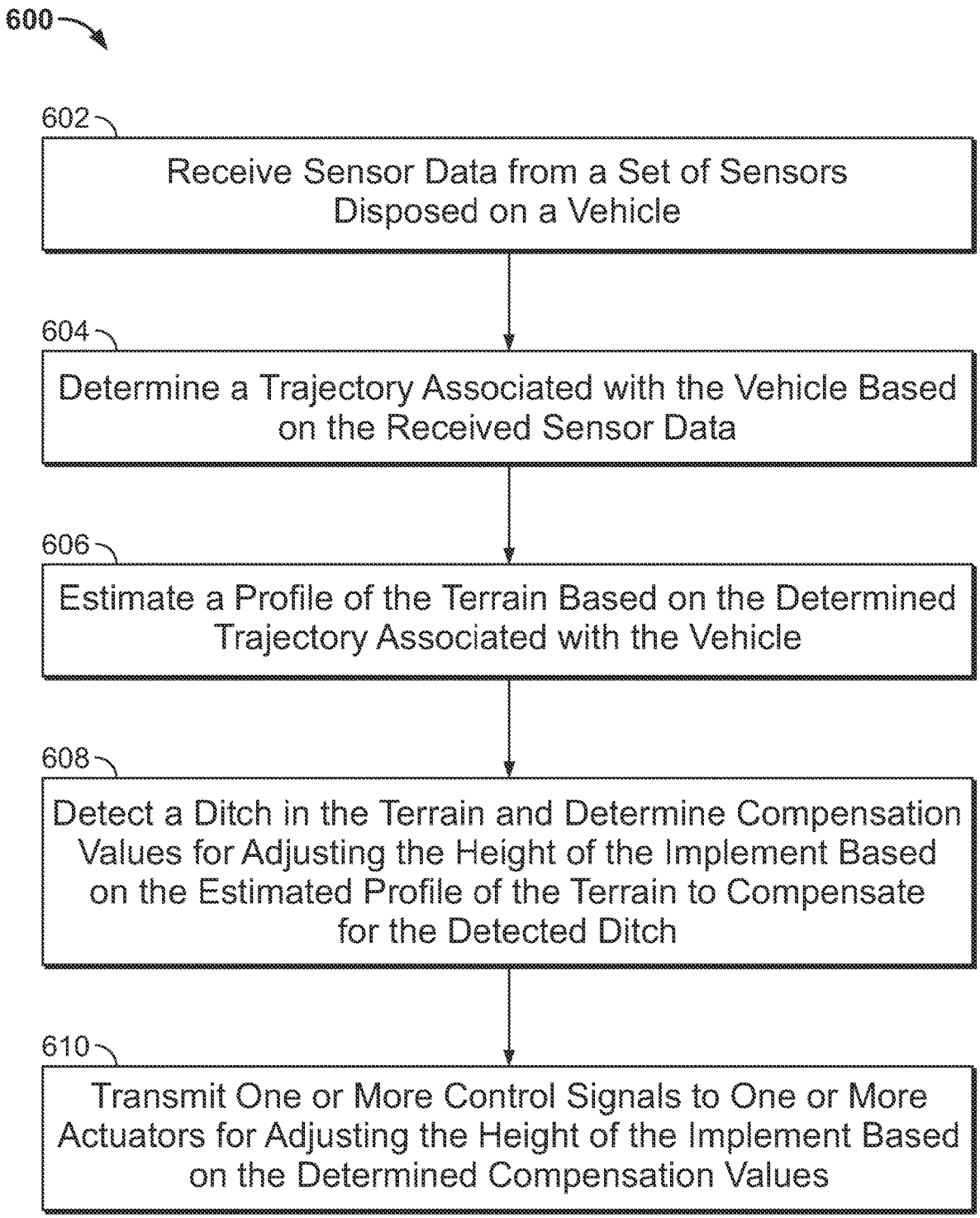
FIG. 6 shows a method for adjusting a height of an implement mounted on a body of a vehicle for a 3D environment, in accordance with one or more embodiments.

FIG. 5 shows a schematic diagram 500 of a predictive control system for adjusting a height of an implement mounted on a body of a vehicle for a 3D environment, in accordance with one or more embodiments. FIG. 6 shows a method 600 for adjusting a height of an implement mounted on a body of a vehicle for a 3D environment, in accordance with one or more embodiments. FIG. 5 and FIG. 6 will be described together. The steps of method 600 of FIG. 6 may be performed by a controller (e.g., controller 120 of FIG. 1) or any other suitable computing device or devices, such as, e.g., computer 1102 of FIG. 11. Exemplary controllers include simple controllers such as PID (proportional-integral-derivative) controllers or PLCs (programmable logic controllers) and more sophisticated controllers such as Smith Predictor or MPC (model predictive control).

The vehicle may be initially travelling over a terrain to manipulate the terrain via the implement to achieve a target terrain surface. The height of the implement of the vehicle is adjusted according to initial error values to achieve the target terrain surface. However, adjusting the height of the implement according to the initial error values may not be able to compensate for some disturbances such as, e.g., ditches in the terrain. In accordance with method 500, compensated values are determined for compensating for ditches and other disturbances in the terrain. The compensated values may be combined with the initial error values to generate final error values for adjusting the height of the implement to achieve the target terrain surface while also compensating for ditches and other disturbances in the terrain.

At step 602, sensor data is received from a set of sensors disposed on a vehicle. The vehicle may be any vehicle having an implement coupled to a body, such as, e.g., a construction vehicle (e.g., a dozing machine having a blade couple to a body or a compact track loader having a blade coupled to a body) or an agricultural vehicle (e.g., a combine harvester having a header coupled to a body). In one example, the vehicle is dozing machine 100 of FIG. 1 having blade 104 coupled to body 102 and sensors 122 and 124. As shown in FIG. 5, the vehicle may be dozing machine 502 and the set of sensors may be sensors 504.

The set of sensors may include any number of suitable sensor or sensors for determining the position and the orientation of the body and the implement of the vehicle, as well as the linear and angular velocities for each axis. In one embodiment, the position is defined in (X, Y, Z) Cartesian coordinates and the orientation is defined in (yaw, pitch, roll) Euler angles. However, it should be understood that the position and the orientation may be represented in any suitable format. Exemplary sensors may include an IMU (inertial measurement unit), a GPS (global positioning system) sensor, an LPS (local positioning system) sensor, a sonic range finder, a laser range finder, an encoder, an in-ram pressure sensor, an odometer, or any other suitable sensor.

The set of sensors may be disposed on the vehicle at any suitable location or locations for determining the position and the orientation of the body and the implement, as well as the linear and angular velocities for each axis. For example, the set of sensors may comprise one or more sensors disposed on the implement and/or one or more sensors disposed on the body. In one embodiment, the set of sensors is disposed on the vehicle in a mastless configuration, where two GPS sensors are mounted on the body, an IMU is mounted on the body, and an IMU is mounted on the implement. The GPS sensors mounted on the body form a main-auxiliary pair and run the RTK (real-time kinematic) algorithm. Optionally, where the vehicle is a dozer machine with a push bar, an additional IMU may be mounted on the push bar. In another embodiment, the set of sensors is disposed on the vehicle in a masted configuration, where one or two GPS sensors are mounted on the implement, an IMU is mounted on the implement, and optionally an IMU is mounted on the body.

At step 604, a trajectory associated with the vehicle is determined based on the received sensor data. The trajectory represents the location of a point associated with the vehicle as the vehicle travels over the terrain. The determination of the trajectory will be described with continued reference to FIG. 5.

To determine the trajectory, a state of the body of the vehicle and a state of the implement of the vehicle are first determined based on the received sensor data. As shown in FIG. 5, observation (estimation) block 506 receives data from sensors 504 to estimate an observed state of the body 508 and state of the implement 510. The state of the body and the state of the implement are defined in terms of 24 parameters, corresponding to the position (e.g., in X, Y, Z Cartesian coordinates) and orientation (e.g., in yaw, pitch, roll Euler angles) of the body and the implement, as well as the linear and angular velocities for each axis.

Referring for a moment back to FIG. 1, dozing machine 100 operates in a three dimensional environment with various frames of reference, such as, e.g., body frame 114 of body 102, blade frame 112 of blade 104, surface patch frame 110 of terrain surface 108, and navigation frame 116 of the navigation of dozing machine 100. The state of the body 102 is defined in terms of its absolute position and orientation in body frame 114 (with respect to some reference point). The state of the blade 104 is defined in terms of its relative position and orientation in blade frame 104 (relative to body frame 114). The absolute position and orientation (in body frame 114, with respect to the reference point) of blade 104 can be determined from its relative position and orientation.

The state of the body and the state of the implement are determined using the following components:

(1) an extended Kalman filter for determining the position and the linear and angular velocities of the body based on: a) the accelerometer output from the IMU mounted on the body, b) the position output from the main GPS mounted on the body, and c) the body orientation (output from the extended Kalman filter in (2));

(2) an extended Kalman filter for determining the orientation of the body based on: a) the gyroscope output from the IMU mounted on the body, b) the baseline (the vector from the auxiliary GPS to the main GPS) output from the auxiliary GPS mounted on the body, and c) the gravity vector (estimated by the body acceleration computer in (3));

(3) a body acceleration computer for estimating the gravity vector at the location of the IMU mounted on the body based on: a) the body velocity (output from the extended Kalman filter in (1)) and b) the gyroscope output from the IMU mounted on the body;

(4) an extended Kalman filter for determining the orientation of the implement based on: a) the gyroscope output from the IMU mounted on the implement and b) the gravity vector (estimated by the implement acceleration computer in (5));

(5) an implement acceleration computer for estimating the gravity vector at the location of the IMU mounted on the implement based on the blade velocity (computed by the blade kinematics module in (6)); and (6) a blade kinematics module for computing the position and the orientation of the implement relative to the body, the linear and angular velocities of the implement, and the angles and rates of the joints of the kinematic structure based on: a) the position and the linear and angular velocities of the body (determined by the extended Kalman filter in (1)) and the orientation of the body (determined by the extended Kalman filter in (2)), b) the orientation and the angular velocities of the implement (determined by the extended Kalman filter in (4)), and c) the kinematic structure of the vehicle (e.g., the skeleton or blueprint of the vehicle). The kinematic structure of the vehicle refers to the number of joints of the vehicle and the way they are positioned with respect to each other. The kinematic structure of the vehicle is further described with respect to FIG. 12 below.

Figure 7:
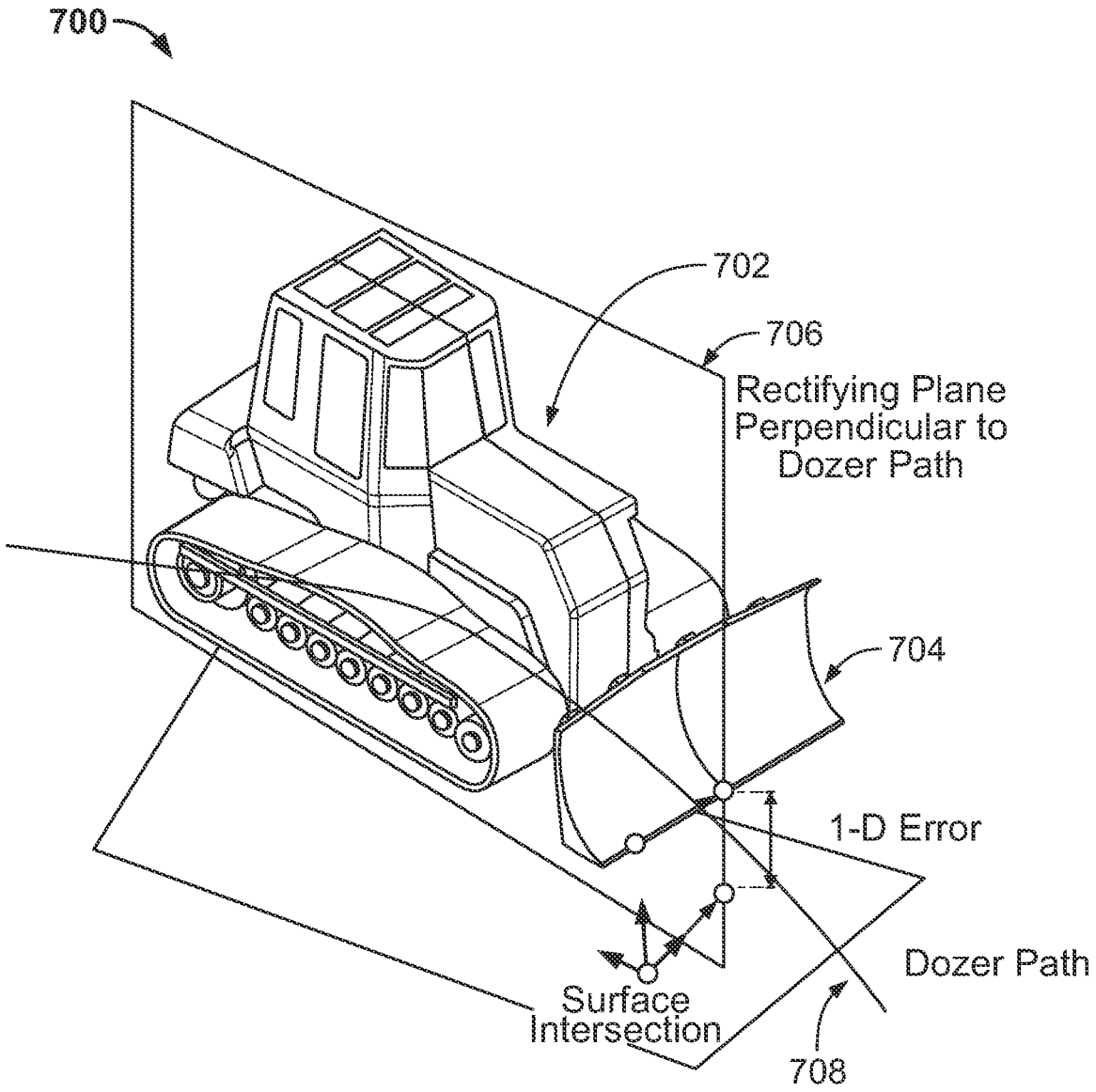
FIG. 7 shows an exemplary dozing machine, in accordance with one or more embodiments.

The state of the body and the state of the implement, along with the target terrain surface, are then mapped to a one dimensional space to determine a one dimensional state of the vehicle as a whole. As shown in FIG. 5, state of the body 508 and state of the implement 510, as well as target terrain surface 512, are mapped to a rectifying plane by mapping to rectifying plane block 514 to determine state of the vehicle 516. Referring for a moment to FIG. 7, a dozing machine 700 comprising a body 702 and a blade 704 is shown travelling along dozer path 708 on a terrain, in accordance with one or more embodiments. The state of body 702 and blade 704 (in terms of position, orientation, and linear and angular velocities) are mapped to rectifying plane 706, which is perpendicular to dozer path 708.

To map the state of body 702 and blade 704 to one dimensional rectifying plane 706, various points of interest on blade 704 are identified:

(1) the middle point of blade 704, defined as being located approximately half-way from both edges of blade 704. The blade middle point is typically the point that determines the elevation of blade 704 with respect to the desired surface when the blade is square (zero yaw);

(2) the edge points of blade 704. For example, the right edge can be used as a reference for measuring up the machine and surveying the locations of sensors. Such an edge can be designated as point (0,0,0);

(3) the point-fit point of interest (POI), defined as an user selected point in between and including the edges of blade 704. By selecting a particular point, through defining a ratio (from 0 to 1, where 0 indicating one edge and 1 the other), users indicates their preference for a particular area of the desired surface of blade 704. In other words, the surface patch directly beneath the POI will be used as the basis of calculating mainfall and cross slope errors. In one embodiment, the default value of the ratio is 0.5 representing the middle point; and (4) the best-fit point of interest, which is the same as a point-fit POI except that it is determined by the control system. In best-fit operation mode, the surface patch selected is based on various factors including which one of the surface patches has biggest overlap with the edge or which one is closest to the blade edge. Typically, the selected best-fit POI is either of the edge points.

One or more of such points of interest are projected onto the 1D plane to intersect at a point referred to as the surface intersection. A goal of the control system is to move blade 704 such that the points of interest (as a function time) converge to the surface intersection (also a function of time) in finite time. More generally, the edge of blade 704 should intersect and lie on the surface patch (which is a spatial plane) that intersects the vertical ray extended from the POI.

Although the embodiments described herein can be extended to 3D, they are greatly simplified and gain much more performance if the problem is cast as one defined on a 2D plane (embedded in 3D space). The middle point of blade 704 should not be a basis for choosing a plane because it varies all the time as the blade tilts and/or rotates. Moreover, the trajectory is created as the body moves. Consequently, this plane is chosen as the sagittal rectifying plane 706 dividing the dozer into two parts (e.g., left and right). It can be shown that this does not compromise generality. In other words, controlling the cylinders on this plane will make sure that the problem is also solved in 3D space.

Formally, the navigation coordinate frame is denoted N($\vec{X}$, $\vec{Y}$, $\vec{Z}$). The center of the navigation coordinate frame is not important. The middle point of blade 704 is denoted m(x, y, z) in 3D space, expressed with respect to the navigation frame. The coordinate frame of the edge of blade 704 (centered at m) is denoted M($\vec{x}$, $\vec{y}$, $\vec{z}$), where unit direction $\vec{y}$ points along the edge of blade 704 (positive towards right), $\vec{z}$ points down along vertical when blade 704 is at the zero position (determined at calibration time), and $\vec{x}$ points forward, orthogonal to the $\vec{y}$ and $\vec{z}$. The point of interest is denoted p(x, y, z). The surface intersection point is denoted s(x, y, z). The surface frame centered at p is denoted S($\vec{U}$, $\vec{V}$, $\vec{W}$). The sagittal rectifying plane 706 is denoted P($\vec{\iota}$, $\vec{j}$, $\vec{k}$), where $\vec{\iota}$ lies on the plane pointing to the front of the machine, $\vec{j}$ is orthogonal to the plane, and $\vec{k}$ is along the local gravity vector.

The state of body 702 and blade 704 may be mapped to rectifying plane 706 as follows. First, a point of interest (the point-fit or best-fit point of interest) is selected by changing the ratio $\alpha$. Using kinematics, the point of interest is represented in the navigation frame to get p(x, y, z). m and M are computed by kinematics, resulting in:

$$p(x,y,z)=m+\alpha*\vec{y}$$

Second, the POI is projected in the vertical direction $\vec{Z}$ to intersect a surface patch of the desired surface. Third, the line segment L, representing the edge of blade 704, is projected onto the surface patch. By definition, point s should already be on this projection. The unit vector $\vec{l}$ is assumed to be on line segment L. Fourth, m is projected along $\vec{y}$ onto P and the projected point is denoted $m_P$. Fifth, s is projected along $\vec{l}$ onto P, where the projected point is denoted $s_P$. Finally, sixth, $m_P$ and $s_P$ are added as a blade point and target surface point respectively to the trajectory. The frames for both points will be the same as P since they reside on the same plane. It is to be noted that yaw and roll of blade 704 will change the position of $m_P$, however this change is much smaller than the change in m, helping the stability of the system.

Referring back to step 604 of FIG. 6, the trajectory associated with the vehicle is determined based on the state of the vehicle. As shown in FIG. 5, state of the vehicle 516 is used by tracking point determination block 518 to determine a trajectory. As the implement passes over the surface of the terrain, the trajectory is formed by adding points to it. The front (start) of the trajectory is a point representing the position of the implement and the tail (end) of the trajectory extends back to a predefined distance from the front. Each point may be located at any position associated with the vehicle. For example, each point may be located at a position determined based on the position of the body and/or the position of the implement.

In one embodiment, each point of the trajectory is determined based on its suitability for eliciting information about the shape of the ground. For example, if the points of the trajectory are taken as the tip of the implement, then it must be assumed that the implement is always in contact with the surface of the terrain, which might not always be true. If the implement pitches up, it will lose contact with the surface of the terrain and lead to fictitious humps and ditches. In another embodiment, each point of the trajectory is determined based on a virtual point on the body. Such a virtual point is located to be under the blade tip, which is further away from the physical body of the vehicle. The virtual point can be thought of as the vertical projection of the tip of the implement down onto the body, had the body been long enough. In another embodiment, each point of the trajectory is a point as representing the surface of the terrain instead of blade tip, which may be a good choice when the body only pitches up and down. In another embodiment, each point of the trajectory can be determined by comparing the vertical heights of the tip of the implement and the virtual point on the body and selecting the point with the lowest vertical height. Where the implement loses contact with the surface of the terrain, the trajectory would still be a reasonable estimate of where the surface of the terrain is. In another embodiment, each point of the trajectory may be determined to represent the surface of the terrain based on the amount by which the implement penetrates the target surface. This would be a good choice if the machine is close enough to the target surface, or, in other words, where the actual surface of the terrain is almost equal to the desired surface. However, for computational purposes, a small dither must be added to the point. Otherwise, the gradient of the point will be a constant value and not zero at inflection points.

In one embodiment, the trajectory is created in a volatile mode. In the volatile mode, points are added to the trajectory without any constraints. Accordingly, as time advances (regardless of whether the vehicle is moving or not), points are estimated and added. Depending on the rate of the system, points might, for example, be added approximately every 10 milliseconds. So, the points are always 10 ms apart in time. However, if the vehicle is static, the points will be forming a cloud centered at the mean of the added points. The width of the cloud is determined by the variances of the ensemble of filters in the system. The trajectory, however, has a maximum capacity. Once the maximum capacity is exceeded, the oldest point added at the end of the trajectory will be removed to make room for a new point. If the vehicle starts to move, over time, the point cloud will form a trail (referred to as a trajectory history). Depending on how fast the vehicle is moving, new points will be spaced apart based on the speed of the vehicle. For example, if the vehicle is travelling at 1 meter per second, with the rate of 10 ms=0.01 sec, in one second approximately 100 points will be added to the trajectory spaced 10 mm apart from each other. Thus, the trajectory will be of variable length as a function of the speed of the vehicle. In another embodiment, the trajectory is created in a retained mode. In the retained mode, the trajectory has a predefined maximum length. Once the predefined maximum length is reached, as points are added to the trajectory at the front, points are dropped from the trajectory at the tail to maintain the predefined maximum length. Points are added to the trajectory spaced apart according to a predefined spacing distance. For both the volatile mode and the retained mode, a time delay limit may be defined between two consecutive points for both the volatile mode and the retained mode. If the delay between two consecutive points exceeds the time delay limit, the trajectory will be reset.

At step 606, a profile of the terrain is estimated based on the determined trajectory associated with the vehicle. The trajectory associated with the vehicle roughly approximates the profile of the terrain, however is a very coarse indicator of the pitching behavior of the body of the vehicle. For example, the trajectory may not be an accurate representation of the profile of the terrain where the vehicle encounters a narrow ditch, where the implement is not in contact with the terrain, or where there is oscillation of the implement. Accordingly, the profile of the terrain is estimated by simulating the pitch of the body as the vehicle travels over the terrain (as approximated by the trajectory). The pitch of the body provides a more accurate profile of the terrain as compared to the trajectory of the vehicle. As shown in FIG. 5, the trajectory is used by body state prediction (simulation) block 520 to predict the profile of the terrain by simulating the pitch of the body.

In one embodiment, motion of the body is simulated using a rigid-body approach to determine the pitch of the body as the vehicle travels over the terrain. In the rigid-body approach, the vehicle is modelled as a rigid body characterized with a mass and a mass moment of inertia (which changes with changes in articulation geometry). Various sub-systems of the vehicle may be modeled in the rigid body model of the vehicle, such as, e.g., the body, the implement, the tracks, and the wheels. In some embodiments, the sub-systems modelled in the rigid body model of the vehicle may also include the suspension system, track shoes, or any other sub-system of the vehicle. To simplify the modelling, the interaction between the tracks and the terrain are modelled without taking into account the portions at the front and back of the tracks that curve up and do not interact with the terrain.

Figure 8:
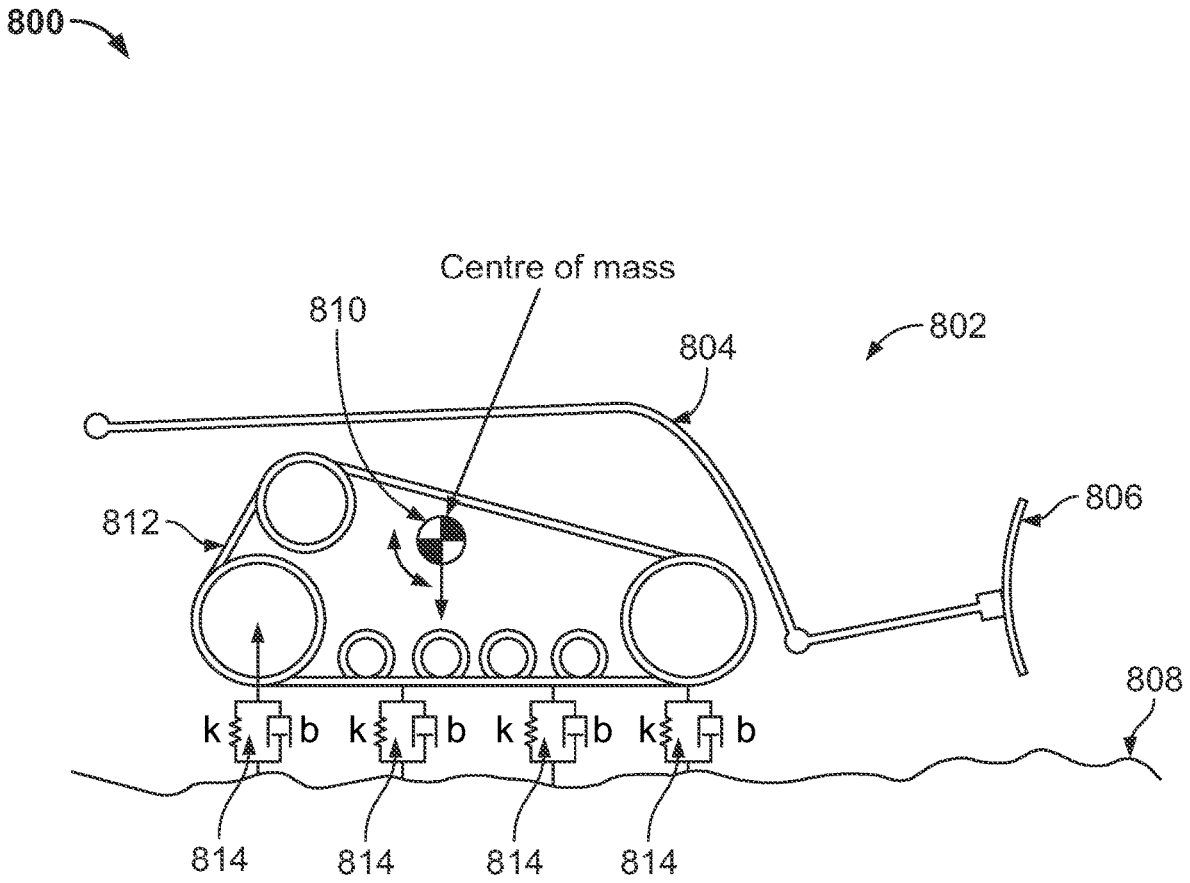
FIG. 8 shows a schematic diagram illustrating a rigid body model of a vehicle, in accordance with one or more embodiments.

FIG. 8 shows a schematic diagram 800 illustrating a rigid body model of a vehicle 802, in accordance with one or more embodiments. Vehicle 802 comprises body 804, implement 806, and tracks 812, and has a center of mass 810. Tracks 812 are made of rubber and may therefore be modelled as an elastic medium that can only strain due to interaction with terrain 808. For simplicity, road wheels of vehicle 804 are not modelled. As shown in FIG. 8, tracks 812 are modelled as a rubber band using imaginary spring-damper pairs 814 between the upper and lower boundaries of the rubber band at locations where tracks 812 contact terrain 808. Spring-damper pairs 814 each comprise spring k and damper b. Tracks 812 may be modelled using any number of spring-damper pairs 814. The higher the number of spring-damper pairs 814 used to model tracks 812, the more accurate the model will be. Spring-damper pairs 814 stress under forces from terrain 808 (at the locations where tracks 812 contact terrain 808) and body 804. In turn, spring-damper pairs 814 exert forces on body 804, resulting in linear forces and rotational torques around center of mass 810. These resultant forces and torques produce linear and angular accelerations, which can be calculated using Newtonian mechanics formulas to calculate the bounce and pitch dynamics of vehicle 802. Integration of the linear and angular accelerations results in vertical speed and pitch angular speed of vehicle 802. Since the speed of vehicle 802 is known, there is no need to model the tractive force of terrain 808, which would have required knowledge of solid shear stress and deformation. Portions of tracks 812 may lose contact with terrain 808 and therefore spring-damper pairs 814 representing those portions of tracks 812 will produce zero vertical force. In some embodiments, the interaction between implement 806 and terrain 808 can also be modelled to provide more accurate and realistic results.

One challenge is to determine the stiffness and damping parameters of springs k and dampers b in spring-damper pairs 814, respectively. The springs k are nonlinear springs that model the elastic behavior of the rubber track 812 and pressure-sinkage behavior of terrain 808. According to Bekker's equation, the pressure-sinkage relation is given by:

$$p = \left(\frac{k_c}{b} + k_\phi\right)y^n$$

where p is pressure, y is the amount of sinkage, b is the radius of the contact area of terrain 808, and $$\frac{k_c}{b},$$

$k_\phi$, and n are empirical constant parameters of terrain 808. The calculated sinkage y represents the force produced by terrain 808 (and applied to springs k). The exponent of y may potentially make the spring k nonlinear.

Returning to FIG. 6, at step 608, a ditch is detected in the terrain and compensation values for adjusting the height of the implement are determined based on the estimated profile of the terrain to compensate for the detected ditch. As shown in FIG. 5, ditch detection algorithm block 522 determines shape profiles (defining compensation values for ditches detected in the terrain) associated with the profile of the terrain.

The profile of the terrain comprises a plurality of points. The ditch is first detected in the terrain by analyzing a current point in the estimated profile of the terrain. The current point in the estimated profile of the terrain is a point at a predetermined distance from the front of the estimated profile of the terrain. As the vehicle travels over the terrain, additional points are be added to the estimated profile of the terrain, advancing the current point forward. Each point in the estimated profile of the terrain is associated with a shape profile representing a shape characteristic of the terrain. Based on the analysis of the current point, the shape profile associated with the current point (and possibly other points) may be updated to define the shape characteristic.

Figure 9:
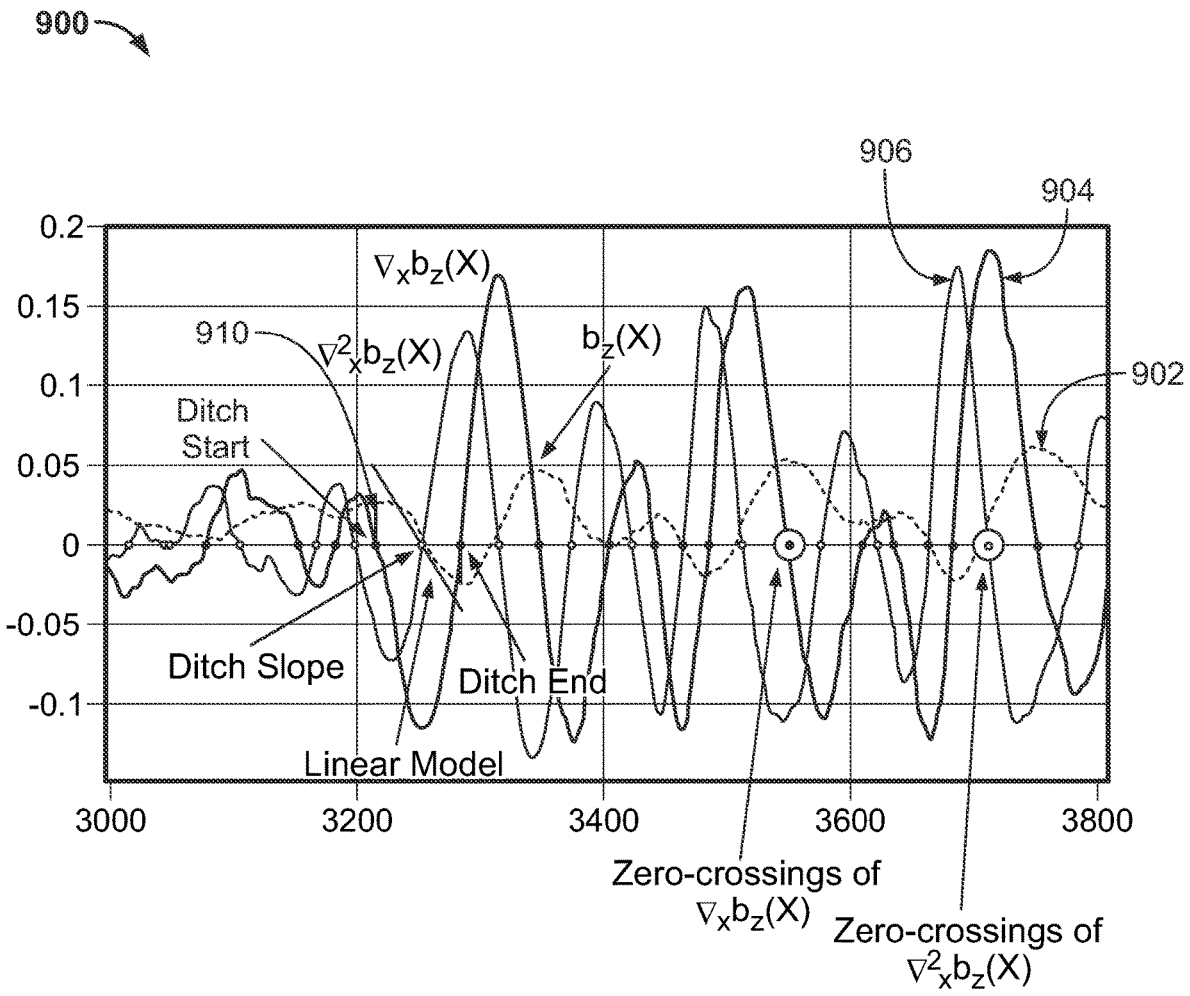
FIG. 9 shows a graph illustrating the detection of ditches in the estimated profile of the terrain, in accordance with one or more embodiments.

FIG. 9 shows a graph 900 illustrating the detection of ditches in the estimated profile of the terrain, in accordance with one or more embodiments. In graph 900, signal 902 represents the estimated profile $b_z(x)$ of the terrain. The detection of a ditch is performed by analyzing the current point in the estimated profile $b_z(x)$. To detect a ditch, a gradient $\nabla_x b_z(x)$ (first derivative) of the estimated profile $b_z(x)$ is first computed and smoothed. The gradient $\nabla_x b_z(x)$ of the estimated profile $b_z(x)$ is shown as signal 904 in graph 900. A second gradient $\nabla_x^2 b_z(x)$ of the estimated profile $b_z(x)$ is then computed and smoothed. The second gradient $\nabla_x^2 b_z(x)$ of the estimated profile $b_z(x)$ is shown as signal 906 in graph 900. It is then determined whether the gradient $\nabla_x b_z(x)$ of the current point of estimated profile $b_z(x)$ is a zero crossing. As shown in graph 900, the gradient $\nabla_x b_z(x)$ of point 908 and point 910 are zero crossings. If the gradient $\nabla_x b_z(x)$ of the current point of the estimated profile $b_z(x)$ is not a zero crossing, the current point is not a ditch or a hump in the terrain and the current point is discarded. If the gradient $\nabla_x b_z(x)$ of the current point of the estimated profile $b_z(x)$ is a zero crossing, it is determined whether the current point in the estimated profile $b_z(x)$ is a ditch or a hump in the terrain by comparing the magnitude of the estimated profile $b_z(x)$ at the current point with the magnitude of the estimated profile $b_z(x)$ at the last point at which the gradient $\nabla_x b_z(x)$ is a zero crossing. For example, the magnitude of point 908 is compared with the magnitude of point 910 to determine that point 908 is a ditch. A ditch is an area between two consecutive zero crossings of the second gradient $\nabla_x^2 b_z(x)$ of the estimated profile $b_z(x)$ with a negative Z value. A hump is an area between two consecutive zero crossings of the second gradient $\nabla_x^2 b_z(x)$ of the estimated profile $b_z(x)$ with a negative Z value.

Compensation values for adjusting the height of the implement are then determined based on the estimated profile of the terrain to compensate for the detected ditch. In particular, if the current point is detected to be a ditch, the estimated profile $b_z(x)$ is traversed back to the last point determined to be a hump (or to the end of the estimated profile $b_z(x)$ if a last point determined to be a hump does not exist). The differential magnitude of the estimated profile $b_z(x)$ at the current point and at the last point determined to be a hump is calculated and used to update the profile associated with the points between the current point and the last point. In one embodiment, compensation values for adjusting the height of the implement may be determined based on the estimated profile of the terrain to compensate for the detected humps. If the current point is detected to be a hump, the estimated profile $b_z(x)$ is traversed back to the last point determined to be a ditch (or to the end of the estimated profile $b_z(x)$ if a last point determined to be a ditch does not exist). The differential magnitude of the estimated profile $b_z(x)$ at the current point and at the last point determined to be a ditch is calculated and used to update the profile associated with points between the current point and the last point.

Each point in the estimated profile $b_z(x)$ associated with an updated profile is identified as being adjusted. Unadjusted points occur where the body of the vehicle is travelling too fast or the ditch is too wide. In these cases, the height of the implement is user defined.

Figure 10:
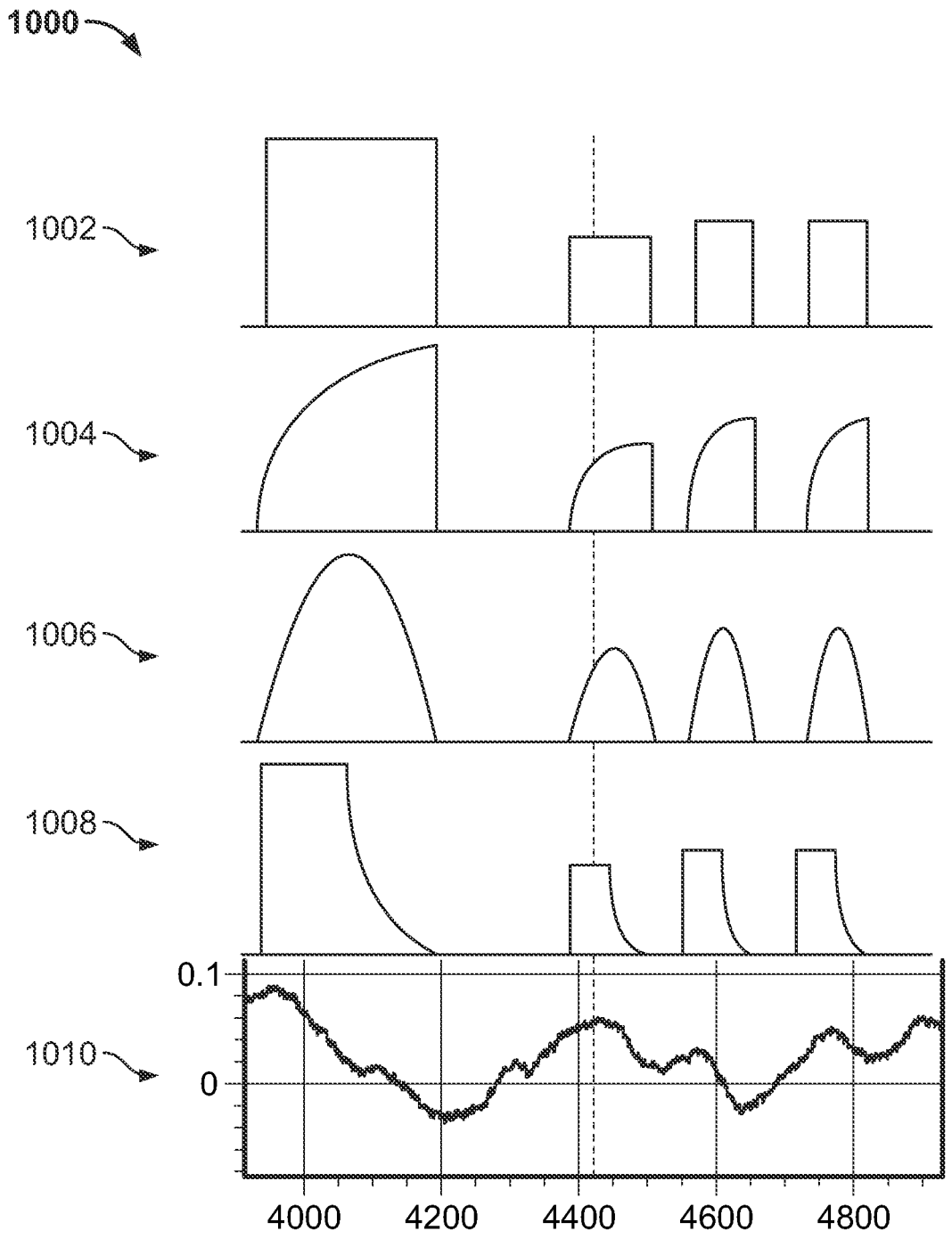
FIG. 10 shows a diagram of various shape characteristics, in accordance with one or more embodiments.

The shape profiles associated with points in the estimated profile $b_z(x)$ detected as being a ditch (i.e., the range of points between the current point and the last point determined to be a hump) may be updated by selecting a shape characteristic of the terrain. The shape characteristics may represent any suitable shape. FIG. 10 shows a diagram 1000 of various shape characteristics for compensating profile of terrain 1010, in accordance with one or more embodiments. Profile of terrain 1010 comprise a number of ditches. Various shape characteristics 1002-1008 may be selected to compensate for such ditches in profile of terrain 1010. As shown in diagram 1000, shape characteristics may include a step shape characteristic 1002, a logarithmic shape characteristic 1004, a quadratic shape characteristic 1006, and a ramp characteristic 1008. Shape characteristics 1002-1008 are shown in diagram 1000 in accordance with various differential magnitudes to compensate for ditches in profile of terrain 1010. Other shape characteristics are also contemplated, such as, e.g., an exponential shape characteristic, complex shape characteristics concatenating two or more shape characteristics, etc. After applying shape characteristics 1002-1008, profile of terrain 1010 would look substantially flat.

The compensation value for each of point in the range of points is determined by combining the shape characteristic with the differential magnitudes. In one embodiment, the shape characteristic may have a height ranging from 0 to 1 and may be overlaid over the range of points. The compensation value for each point may be determined by multiplying the height of the shape characteristic with the differential magnitude.

Figure 11:
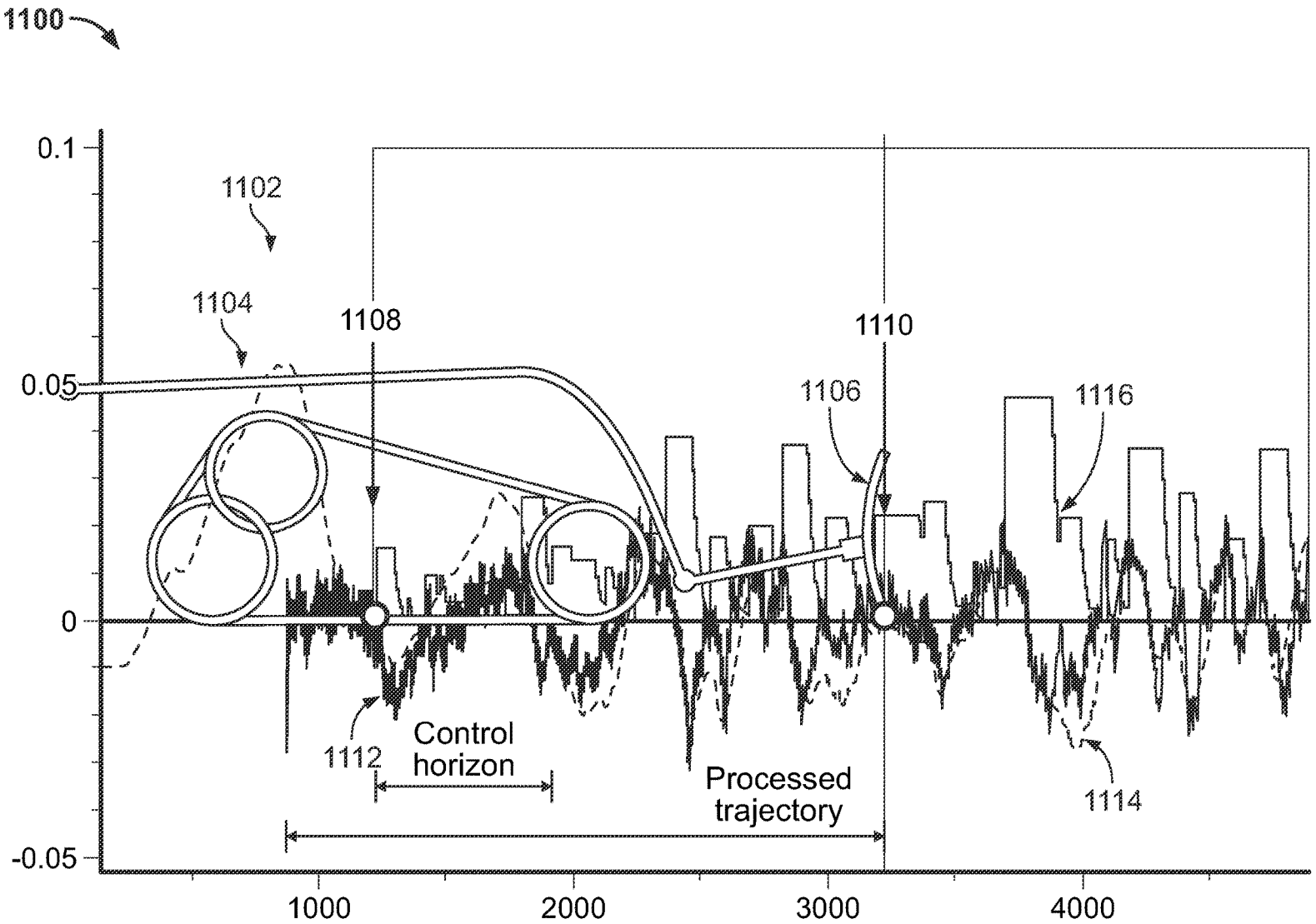
FIG. 11 shows a graph depicting compensation of ditches, in accordance with one or more embodiments

FIG. 11 shows a graph 1100 depicting compensation of ditches, in accordance with one or more embodiments. Vehicle 1102 comprises body 1104 and implement 1106. Body 1104 has center of mass 1108 and implement 1106 has a tip 1110. As vehicle 1102 travels over the surface of a terrain, a trajectory 1112 is created representing an estimated profile of the surface of the terrain. Signal 1114 shows the true body pitch of vehicle 1102 as it travels over the surface of the terrain. A correction profile 1116 comprising various shape characteristics is applied to compensate for ditches detected in trajectory 1112.

Returning to FIG. 6, at step 610, one or more control signals are transmitted to one or more actuators for adjusting the height of the implement based on the determined compensation values. In one example, the actuators may be actuators 118 in FIG. 1. The actuators may be hydraulic cylinders or drives or any other suitable actuator. In FIG. 5, the profile of the terrain with associated shape profiles are used by low-level controller 526 to transmit one or more control signals to hydraulic system 530 of dozing machine 502. The control signals comprise instructions for adjusting the height of the implement to achieve the target terrain surface while also compensating for ditches and other disturbances in the terrain. In one embodiment, the initial error values for achieving the target terrain surface are combined (e.g., added) with the compensation values to generate final error values. The control signals are generated to comprise instructions for adjusting the height of the implement according to the final error values.

In some embodiments, a simple controller (e.g., a PID controller) performing method 600 may perform poorly due to actuator delay. Predictive controllers (e.g., Smith Predictor, MPCs) and other more sophisticated controllers may be able to suitably perform method 600, but require mathematical modelling of the behavior vehicle. In accordance with one embodiment, the vehicle may be mathematically modelled. In FIG. 5, the vehicle is mathematically modelled by black state predictor block 528.

Figure 12:
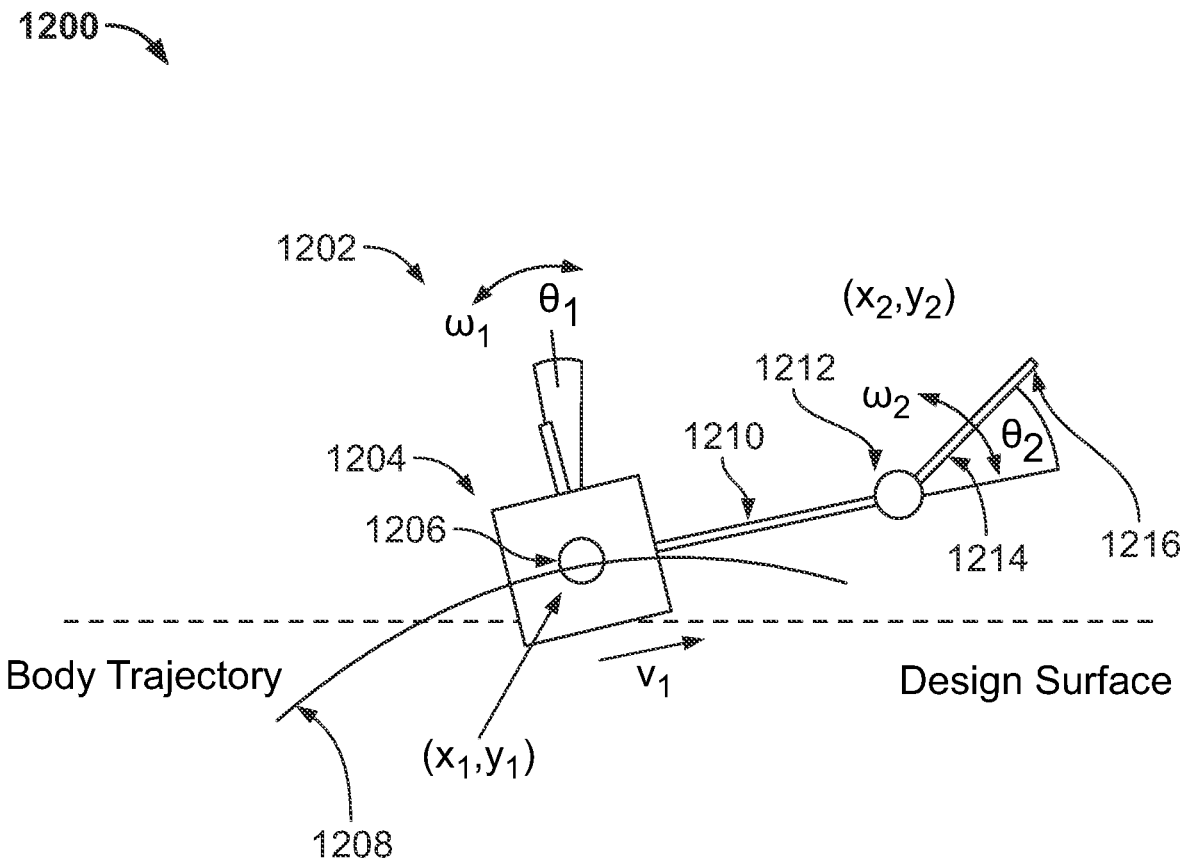
FIG. 12 shows an exemplary schematic diagram of a vehicle, in accordance with one or more embodiments.

FIG. 12 shows an exemplary schematic diagram 1200 of a vehicle, in accordance with one or more embodiments. As shown in FIG. 12, vehicle 1202 comprises a body 1204 positioned at $(x_1, y_1)$ with center of mass 1206. Center of mass 1206 of body 1204 travels over a surface 1208 of a terrain (represented as the body trajectory) with velocity $v_1$. Body 1204 pitches around center of mass 1206 by angular rate $\omega_1$ producing body pitch $\theta_1$. Rod 1210 extends from body 1204 and is linked to boom 1214 via pivot 1212. Boom 1214 pitches around pivot 1212 by angular rate $\omega_2$ producing body pitch $\theta_2$. End point 1216 of boom 1214 is configured to couple to a blade. End point 1216 has a position $(x_2, y_2)$. The blade is not important to the basic kinematics and will therefore be assumed to be composed of a point.

The kinematic model for the schematic diagram 1200 is given as follows:

$$\dot{x}_1 = v_1 \cos(\theta_1)$$

$$\dot{y}_1 = v_1 \sin(\theta_1)$$

$$x_2 = x_1 + l_1 \cos(\theta_1) + l_2 \cos(\theta_1 + \theta_2)$$

$$y_2 = y_1 + l_1 \sin(\theta_1) + l_2 \sin(\theta_1 + \theta_2)$$

$$\dot{x}_2 = \dot{x}_1 - l_1\omega_1 \sin(\theta_1) - l_2(\omega_1 + \omega_2)\sin(\theta_1 + \theta_2)$$

$$\dot{y}_2 = \dot{y}_1 + l_1\omega_1 \cos(\theta_1) + l_2(\omega_1 + \omega_2)\cos(\theta_1 + \theta_2)$$

$$\dot{x}_2 = v_1 \cos(\theta_1) - l_1\omega_1 \sin(\theta_1) - l_2(\omega_1 + \omega_2)\sin(\theta_1 + \theta_2)$$

$$\dot{y}_2 = v_1 \sin(\theta_1) + l_1\omega_1 \cos(\theta_1) + l_2(\omega_1 + \omega_2)\cos(\theta_1 + \theta_2)$$

The state-space model for the schematic diagram 1200 is given as follows:

$$\dot{x}_1 = v_1 \cos(x_3) - l_1\omega_1 \sin(x_3) - l_2(\omega_1 + \omega_2)\sin(x_3 + x_4)$$

$$\dot{x}_2 = v_1 \sin(x_3) + l_1\omega_1 \cos(x_3) + l_2(\omega_1 + \omega_2)\cos(x_3 + x_4)$$

where the state is $\vec{x} = (x_1, x_2, x_3, x_4)^T = (x_2, y_2, \theta_1, \theta_2)^T$, the input is $\vec{u} = (v_1, \omega_1, \omega_2)^T$, the reference input is $\vec{u_d} = (v_1, \omega_1, 0)^T$, and $x_d = x_2 = y_2 = 0$ gives the reference trajectory. $\omega_1$ is the only controlled variable. However, the control of $\omega_1$ is not direct, but is the output of the actuator. In one embodiment, the actuator models can be identified as having a first or second order lag step response with a time delay. Such models can also be expressed in the state space and, together with the differential kinematic model of the body and implement, form the complete model for the system.

A linear state space model for a typical dozing machine (including a CTL) will now be derived. This model is based on the kinematic structure of the vehicle. The vehicle will be modeled as being composed of rigid links connected to (and moving with respect to) each other via 1 degree of freedom joints. Links can have arbitrary shapes and are characterized by their location and orientation with respect to a reference frame. To each link is attached a coordinate frame. To each joint is attached a unit vector indicating motion along or around it, depending on the type of the joint. Sensor positions and other important points of the machine are considered to be part of some link. These points are expressed with respect to the link they are attached to. Links and joints together form open (or closed) chains or trees. Such a rigid-body model can be very detailed but only a sufficiently detailed one will be discussed here.

The linear state space model will have the following links and joints in sequence:

(1) The vehicle body is the first link in the chain. An IMU and two GPS antennas are rigidly attached to it. It is in contact with the ground and its position and orientation are determined through complex interactions with the soil. Such a link is called mobile and its motion is not determined by motion of the joints (at least not directly).

(2) The boom (push arm) link is attached to the body via the pivot joint. This link's motion is constrained by the pivot joint. An IMU can be installed on this link. This is the main mechanism for changing the elevation of the blade.

(3) The blade is attached to the boom through a spherical joint (called the blade center of rotation). This joint is modelled as being composed of three 1 degree of freedom joints occupying the same position. The first two links connecting the three (virtual) joints are modeled as having zero length (so, they are just imaginary links). The third link is the blade itself. A number of sensors can be attached to the blade, including, e.g., an IMU, one or two GPS antennas, sonic sensors, etc. Moreover, the most important entity on the blade link is the middle point and its coordinate frame. The blade can go through yaw, pitch and roll motions around the center of rotation.

The kinematics-dynamics module in the proposed system has the following responsibilities:

(1) Body dynamics: determine the position, orientation, linear and angular velocities of the body link using a dynamic model of track-soil interaction. Note that this information is already estimated by the observer module using GPS and inertial sensors on the body. This modeling is used for prediction.

(2) Blade inverse kinematics: given location, orientation, and angular rates of the body as well as orientation and angular rates of the blade, determine the values and rates of all the joints connecting the body to the blade.

(3) Blade forward kinematics: given position, orientation, linear and angular velocities of the body, as well as joint values and rates, determine blade location, linear velocity and acceleration.

(4) Blade dynamics: together with body dynamics, simulate (predict) blade motion using actuator models for valves-cylinders that move the blade with respect to the body.

Formally, $p_{Blade}^{Nav}(x, y, z)$ denotes the position of the reference point (0,0,0) on the blade link expressed in the navigation frame. This same point, expressed in the blades own frame will be denoted by $p_{Blade}^{BLade}(x, y, z)$ or simply $p_{Blade}(x, y, z)$. Other points on the blade are relative to this point such as m(x, y, z), the blade middle point. One choice for $p_{Blade}$ is m itself. $R_{Blade}^{Nav}$ denotes the rotation matrix of the blade frame in navigation frame. $R_{Blade}^{Body}$ denotes the rotation matrix from body frame to blade frame. $R_{Blade}^{Nav}$ denotes the rotation matrix from blade to navigation frame. $p_{Body}^{Nav}(x, y, z)$ denotes an arbitrary point on the body but usually taken to be the center of mass. $R_{Body}^{Nav}$ denotes the rotation matrix from body to navigation frame.

As noted above, the kinematic structure has 5 links connected by 4 joints. All the joints are rotary. The joint angles are denoted $\Theta(t)=(\theta_1, \theta_2, \theta_3, \theta_4, \theta_5)$. A description of each joint is as follows:

(1) $\theta_1(t)$ is the angle (i.e., the pitch) of the boom with respect to an initial reference (typically the angle it makes with the flat surface on which the body is located when the blade edge is resting on the surface). This pitching happens around the $\vec{y}$ direction of the body frame.

(2) $\theta_2(t)$ is the rotation (i.e., the yaw) of the blade around a vector perpendicular to the boom.

(3) $\theta_3(t)$ is the tilt (i.e., roll) of the blade around the forward direction $(\vec{x})$ of the yawed blade.

(4) $\theta_4(t)$ is an additional pitch around the $\vec{y}$ direction of the yawed and rolled blade.

It is to be noted that due to the actual mechanism of the implement, $\theta_2(t)$, $\theta_3(t)$ and $\theta_4(t)$ are not independent of each other. $\theta_3(t)$ will change if $\theta_2(t)$ changes, and the same is true for $\theta_4(t)$. Change in $\theta_3(t)$ can be compensated by tilting the blade, however $\theta_4(t)$ is a characteristic of the vehicle and cannot be manipulated with actuators.

$\Theta(t)$ Is an element of the joint space of the implement. Each value of $m^{Body}(x, y, z)$ (blade middle point in body frame) corresponds to a unique $\Theta(t)$ (not true in general but true in our special kinematic structure). These two are related by the formula $$p_{Blade}^{Body}(x(t),y(t),z(t))=K_p(\Theta(t))$$

where $K_p(\Theta(t))$ is the kinematic mapping. This mapping can be constructed using robotics algorithms. Briefly, it involves constructing special 4 by 4 matrices (homogeneous transformations) $A_i(\theta_i)$ for each link-joint, multiplying them together and then extracting the position part:

$$K_p(\Theta)=K(\Theta)*(0001)^T$$

where $$K(\Theta)=A_1(\theta_1)*A_2(\theta_2)*A_3(\theta_3)*A_4(\theta_4)*A_5(\theta_5)$$

is the homogeneous kinematics matrix, such that $$R_{Blade}^{Body} = K_R(\Theta) = K(\Theta)*\begin{bmatrix} I_{3\times3} & 0_{3\times1} \\ 0_{1\times0} & 1 \end{bmatrix}.$$

Also, $$\dot{p}_{Blade}^{Body}(x,y,z)=J_p(\Theta(t))*\dot{\Theta}(t)$$

where $J_p(\Theta(t))=\partial K_p(\Theta)/\partial\Theta$ is the Jacobian matrix and $\dot{\Theta}(t)$ is the rate of change of joint values. More generally, $$\begin{bmatrix} v_{Blade}^{Body} \\ \omega_{Blade}^{Body} \end{bmatrix} = \begin{bmatrix} J_p(\Theta) \\ J_R(\Theta) \end{bmatrix} * \dot{\Theta}$$

The forward kinematics model can now be states as $$\begin{bmatrix} p_{Blade}^{Nav} \\ \dot{p}_{Blade}^{Nav} \end{bmatrix} = \begin{bmatrix} p_{Body}^{Nav} + R_{Body}^{Nav} * K(\Theta) \\ \dot{p}_{Body}^{Nav} + R_{Body}^{Nav} * (K(\Theta) \times \omega_{Body}) + J(\Theta) * \dot{\Theta} \end{bmatrix}$$

where $\omega_{Body}$ is the angular rates of turn of the body around its axes.

For blade inverse kinematics, $\Theta(t)$ needs to be found given $R_{Blade}^{Nav}$ and $R_{Body}^{Nav}$. These matrices are independently estimated by the observer module. To do this, it is noted that the dozer blade mechanism can be modeled by the rotation matrix constructed as a Tait-Bryan angle sequence Y1-Z2-X3:

$$R=R_{Blade}^{Body}=R_{Body}^{Nav^{-1}}*R_{Blade}^{Nav}=R_y(\theta_1)*R_z(\theta_2)*R_{x''}(\theta_3)$$

which, when expanded, becomes:

$$\begin{bmatrix} \cos(\theta_1)*\cos(\theta_2) & \sin(\theta_1)*\sin(\theta_3)-\cos(\theta_1)*\cos(\theta_3)*\sin(\theta_2) & \cos(\theta_3)*\sin(\theta_1)+\cos(\theta_1)*\sin(\theta_2)*\sin(\theta_3) \\ \sin(\theta_2) & \cos(\theta_2)*\cos(\theta_3) & -\cos(\theta_2)*\sin(\theta_3) \\ -\cos(\theta_2)*\sin(\theta_1) & \cos(\theta_1)*\sin(\theta_3)+\cos(\theta_3)*\sin(\theta_1)*\sin(\theta_2) & \cos(\theta_1)*\cos(\theta_3)-\sin(\theta_1)*\sin(\theta_2)*\sin(\theta_3) \end{bmatrix}$$

Thus, the angles are easily computed as $$\theta_2 = a\sin(R_{2,1})$$

$$\theta_1 = a\sin\left(-R_{3,1}\Big/\sqrt{1-R_{2,1}^2}\right)$$

$$\theta_3 = a\sin\left(-R_{2,3}\Big/\sqrt{1-R_{2,1}^2}\right)$$

This method is complemented with a calibration phase. The reason is if the blade rolls, the boom pitch calculated will be in error. Thus, while calibrating the machine, the apparent observed boom pitch due to tilting must be modeled and subtracted from the value computed here. A quadratic curve is sufficient to model this dependence.

In case an additional IMU is installed on the boom, $\theta_1$ does not need to be estimated and can be easily determined using the extra IMU as an inclinometer. Dependence of $\theta_4$ on yaw, on the other hand, must always be calibrated. Again, a quadratic curve can model this dependence with sufficient accuracy.

For computing angle rates, we can use $$\dot{\Theta}(t)=J_p(\Theta(t))^{-1}\omega_{Blade}{}^{Body}=J_p(\Theta(t))^{-1}(\omega_{Blade}-\omega_{Body})$$

The rates for computing joint rates are measured by the IMUs on the body, boom, and blade. However, when the above model is used for predictive control, these rates are the output of the dynamic model of the actuators. A full hydraulic model is too cumbersome and also inaccurate if necessary sensors are not installed, which is normally the case in practice. However, simplified models for the dynamics of hydraulic valves can be easily constructed. Such a model would receive a valve command as input and will output the resultant speed of extension-retraction. In a dozer, the change in length of different cylinders ultimately leads to rotary motion of links around the joints. Thus, the hydraulic models can be thought of as mappings between valve command and joint angular rate. Boom pitch and blade tilt are the only controllable joints resulting in $$\omega=\dot{\theta}=T(c)$$

where T( ) denotes the transfer function and cis valve command. The transfer function can be experimentally identified. A second order transfer function with delay $$\frac{\Omega(s)}{C(s)} = \frac{K}{\tau^2 s^2 + 2\tau\zeta s + 1}e^{-d_\tau s}$$

has been shown to be more than sufficient for describing the relationship between a command sent to the valve and the measured angular velocity. The measurement can be done using the onboard IMUs.

Finally, a dynamic model is used to compute body angular velocity of the body when in contact and interacting with the ground. The ground refers to the estimate of the surface of the terrain on which the body will be moving, in accordance with embodiments described herein. This ground is represented as a curve in 2D space (a profile). It has to be endowed with soil properties to make the interaction realistic. As was previously discussed, a real-time rigid-body approach may be used. It is assumed that a lumped model can be used, comprising a body with mass and moment of inertia, and a series of discrete spring-damper elements attached to and distributed along the track. Interaction can further be limited to the bottom of the track. Here, interaction between the edge of the blade and the ground is not modelled as this would need a force sensor. It is also assumed that there are no suspensions between road wheels and the body (no so safe an assumption in the case of machines like tanks). The parameters selected for the stiffness K and damping D of the individual elements must cater for and represent the properties of the rubber as well as the soil.

For a particular soil type, Bekker's equation (with n=1) gives the relationship between the amount of penetration into the soil and the generated force. But this is exactly the definition of a linear spring. The tabulated parameters of the soil can be used to compute an estimate of the stiffness coefficient of the springs. Damping is added to complement the model. Its value is estimated through experiments.

Given that the problem has been reduced into a 2D one, suppose that travel occurs along x and points have coordinates (x, z). Denote by $z_c(t)$ the height of the center of mass of the body. M and I denote the mass and moment of inertia of the body, respectively. The moment of inertia can, in general, be variable if the change in position of the implement with respect to the body is significant.

Forward speed can, in principle, be found by modeling tractive force between the track and the ground but, in this case, it is known (observed) at the beginning of prediction and can be considered to remain constant during the prediction horizon. Thus, $$\dot{x}_c(t)=v$$

The bounce dynamic equation of the body can be stated as $$\ddot{z}_c(t) = \frac{1}{M}\Sigma_{i=1}^{N} f_i(t)$$

where $$f_i(t) = K(z_i(t) - g_i(x(t))) - D(\dot{z}_i(t) - \dot{g}_i(x(t)))$$

$$z_i(t) = z_c(t) - l_i(\cos(\phi_i)\sin(\theta(t)) + \sin(\phi_i)\cos(\theta(t)))$$

$$\dot{z}_i(t) = \dot{z}_c(t) - l_i(\cos(\phi_i)\cos(\theta(t)) + \sin(\phi_i)\sin(\theta(t)))\dot{\theta}(t)$$

$$\dot{g}_i(x) = \frac{\partial}{\partial x}g_i(x)\dot{x}_c$$

and where θ(t) is the pitch of the body.

Similarly, for the pitch dynamics we have:

$$\ddot{\theta}(t) = \frac{1}{I}\Sigma_{i=1}^{N}\tau_i(t)$$

where $$\tau_i(t)=l_i f_i \cos(\phi_i)\cos(\theta)$$

In one embodiment, the performance of a control system in accordance with method 600 may be assessed. To assess the control system, the predicted body pitch (determined at step 606) is correlated with the actual body pitch after the body passes over the point where the implement was located. In FIG. 5, the correlate with body block 524 correlates the predicted body pitch with the actual body pitch. The assessment can be used to adjust the confidence in the validity of the compensation. The assessments may be output to a supervisory control box for automatically adjusting behaviors and parameters or a user for manual adjustment of behaviors and parameters. Two correlations are of interest: 1) body-to-body correlation and 2) body-to-implement correlation.

The body-to-body correlation measures the predictability of the interaction between the tracks and the terrain. To calculate the body-to-body correlation, body pitch will be compared to the Z component of a virtual body point located a certain distance from the center of mass of the body. The certain distance is the same distance as the distance between the point at the center of mass of the body and a point at the edge of the implement. If the height of the virtual point corresponds (correlates) with the height of the point at the center of mass of the body (representing the pitch pattern of the body), there is a higher chance that the body will behave as expected when it reaches the location of the virtual point. A higher correlation indicates a higher confidence in the determined compensation values.

The body-to-implement correlation measures the amount that the motion of the implement can predict motion of the body. This correlation is calculated by comparing pitch of the body with the Z component of a point on the implement. A higher body-to-implement correlation indicates oscillatory behavior of the implement. Thus, the control system should reduce the body-to-implement correlation.

Figure 13:
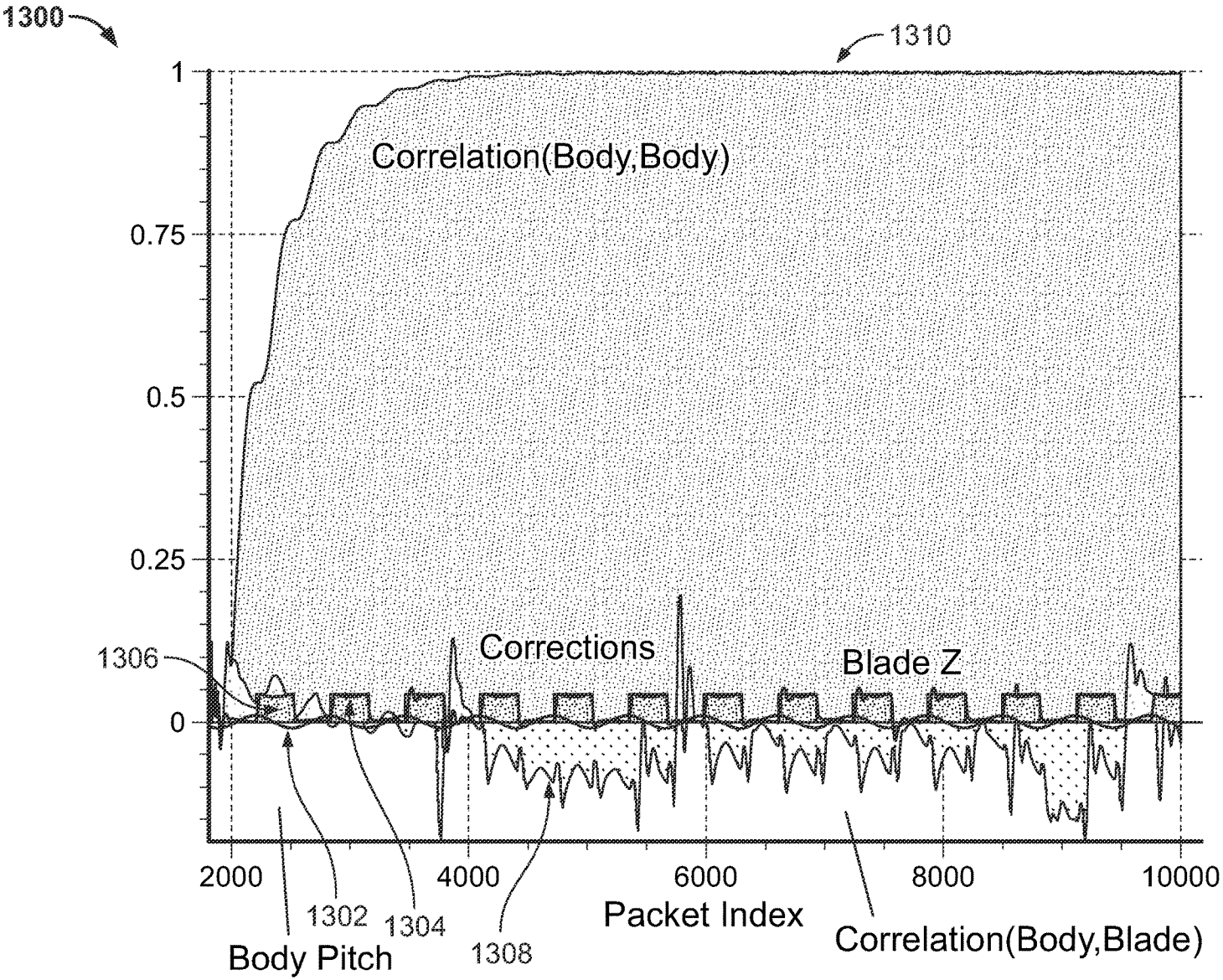
FIG. 13 shows a graph illustrating body-to-body correlations and body-to-implement correlations of the vehicle, in accordance with one or more embodiments.

In one example, a vehicle travels over a perfectly sinusoidal terrain. FIG. 13 shows a graph 1300 illustrating body-to-body correlations and body-to-implement correlations of the vehicle as the vehicle travels over the sinusoidal terrain, in accordance with one or more embodiments. Signal 1302 represents the pitch of the body, which is sinusoidal due to the sinusoidal terrain. Signal 1306 represents corrections of the height of the implement, determined in accordance with embodiments described herein. The corrections were applied as a step shape characteristic. Signal 1304 represents the position of the implement adjusted according to the corrections. As shown in graph 1300, the position of the implement (signal 1304) tracks the corrections (signal 1306) fairly well. Accordingly, the body-body correlation (signal 1310) is high and the body-implement correlation (signal 1308) is low, which indicates good performance. For a well-performing system, the implement is perfectly out of synch with the pitch of the body.

The lack of confidence of the correlations may be computed as follows $$\sigma(t) = \frac{\sigma_{soil} \cdot \sigma_{bb}}{\sigma_{bu}}$$

where $\sigma_{ub}$ and $\sigma_{bb}$ represent body-body correlation and body-implement correlation respectively and $\sigma_{soil}$ represents softness of the terrain. The softer the terrain, the less chance that the body exhibits expected behavior. In other words, the softer terrain may result in the terrain changing shape and/or the position of the implement not representing the profile of the terrain. In such a situation, the strength of the corrections should be decreased.

Method 600 may be performed by any suitable controller. In one embodiment, the controller is a low-level controller. The low-level controller ensures that the edge of the implement tracks the surface of the terrain according to the target surface. The problem was reduced to that of convergence and tracking of one point on the plane s(x, z) (target level) by another p(x, z) (projection of blade edge on body sagittal). This is called elevation (mainfall) control for dozers. At the same time, the controller must also make sure that the whole edge is on the desired cross-slope (as dictated by the surface). The mainfall and cross-slope errors are denoted $e_{mainfall}$ and $e_{cross\text{-}slope}$, respectively. Cross-slope control can be thought of as being orthogonal to mainfall control and can be done independently from the other. The actuators effecting these two can be actuated separately but there is coupling between them due to the hydraulic system. It is, then, beneficial to couple them to achieve smooth tracking and avoid setpoint chasing. For example, an smooth switching (weighting) mechanism such as $$K_{elevation} = Ke^{(-\lambda e_{cross\text{-}slope})}$$

can make sure that the desired cross-slope has been adequately achieved before attempting elevation (boom pitch) adjustment with full force. Here, $K_{elevation}$ is the gain of the elevation controller.

Figure 14:
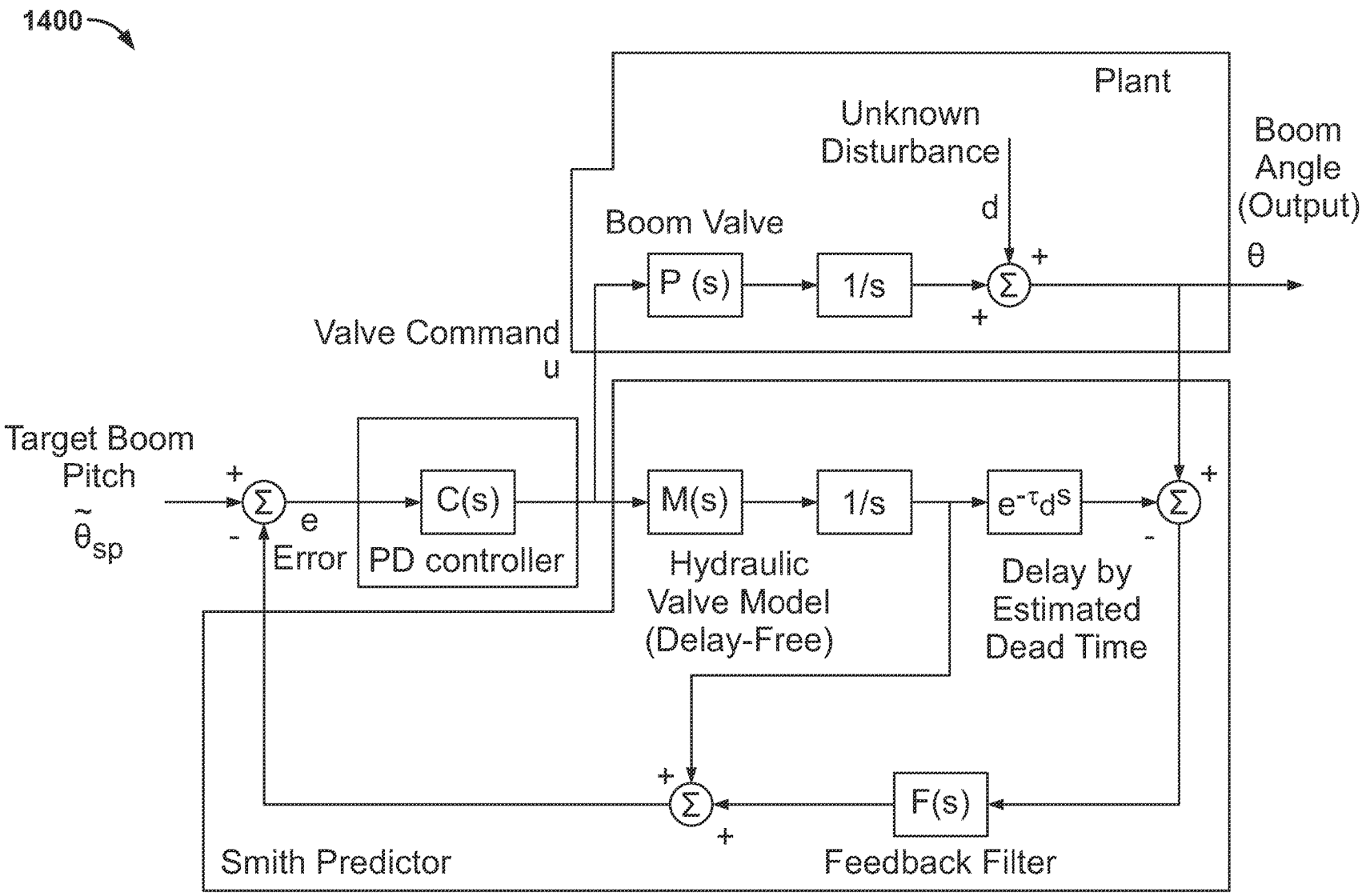
FIG. 14 shows an exemplary Smith predictor type controller, in accordance with one or more embodiments.

Due to the delay in actuators, the controller should be able to cope with output delay in plants. One suitable controller is a specially tuned PID controller. However, since the valve model is known with sufficient accuracy through measurements, a better solution would be a Smith predictor type controller. An exemplary Smith predictor type controller 1400 is shown in FIG. 14. Smith predictor type controller 1400 converts the elevation error to pitch error. As an alternative, a MPC (model predictive control) controller may be utilized. The dynamic model derived above will form the backbone of the MPC controller. The MPC controller uses the model to predict the future behavior of the system as a whole within a bounded horizon.

It should be understood that the scope of the embodiments described herein is more general and may be easily applied to systems equipped with other means of determining the profile of the surface of the terrain. For example, the profile of the surface of the terrain may additionally or alternatively be determined using an optical sensor (e.g., laser sensor) directed towards the surface of the terrain, possible mounted on the boom. If using the optical sensor mounted on the boom, instead of determining the point of the trajectory as described above, the point may be computed using a kinematic formula based on body position and orientation, boom pitch angle, location of the optical sensor on the boom, and the distance measured by the optical sensor.

Systems, apparatuses, and methods described herein may be implemented using digital circuitry, or using one or more computers using well-known computer processors, memory units, storage devices, computer software, and other components. Typically, a computer includes a processor for executing instructions and one or more memories for storing instructions and data. A computer may also include, or be coupled to, one or more mass storage devices, such as one or more magnetic disks, internal hard disks and removable disks, magneto-optical disks, optical disks, etc.

Systems, apparatus, and methods described herein may be implemented using a computer program product tangibly embodied in an information carrier, e.g., in a non-transitory machine-readable storage device, for execution by a programmable processor; and the method and workflow steps described herein, including one or more of the steps or functions of FIGS. 3 and 5-6, may be implemented using one or more computer programs that are executable by such a processor. A computer program is a set of computer program instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Figure 15:
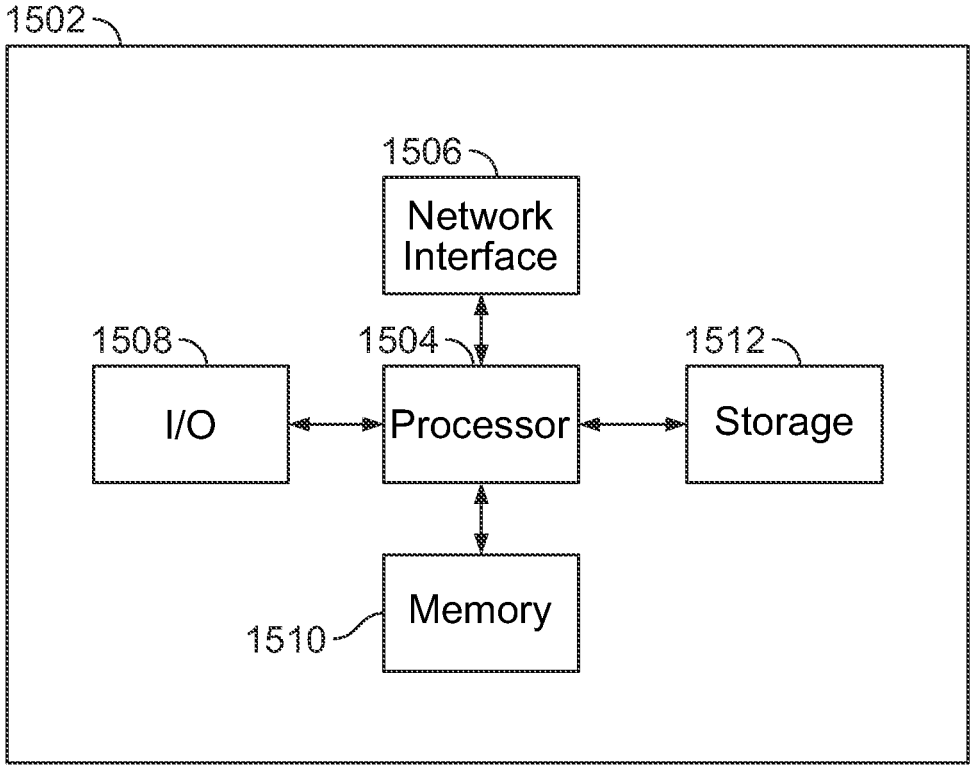
FIG. 15 shows a high-level block diagram of a computer that may be used to implement one or more embodiments.

A high-level block diagram of an example computer 1502 that may be used to implement systems, apparatus, and methods described herein is depicted in FIG. 15. Any or all of the systems and apparatus discussed herein, including controller 120 of FIG. 1, controller 400 of FIG. 4, and controller 1400 of FIG. 14, may be implemented using one or more computers such as computer 1502. Computer 1502 includes a processor 1504 operatively coupled to a data storage device 1512 and a memory 1510. Processor 1504 controls the overall operation of computer 1502 by executing computer program instructions that define such operations. The computer program instructions may be stored in data storage device 1512, or other computer readable medium, and loaded into memory 1510 when execution of the computer program instructions is desired. Thus, the method and workflow steps or functions of FIGS. 3 and 5-6 can be defined by the computer program instructions stored in memory 1510 and/or data storage device 1512 and controlled by processor 1504 executing the computer program instructions. For example, the computer program instructions can be implemented as computer executable code programmed by one skilled in the art to perform the method and workflow steps or functions of FIGS. 3 and 5-6. Accordingly, by executing the computer program instructions, the processor 1504 executes the method and workflow steps or functions of FIGS. 3 and 5-6. Computer 1504 may also include one or more network interfaces 1506 for communicating with other devices via a network. Computer 1502 may also include one or more input/output devices 1508 that enable user interaction with computer 1502 (e.g., display, keyboard, mouse, speakers, buttons, etc.).

Processor 1504 may include both general and special purpose microprocessors, and may be the sole processor or one of multiple processors of computer 1502. Processor 1504 may include one or more central processing units (CPUs), for example. Processor 1504, data storage device 1512, and/or memory 1510 may include, be supplemented by, or incorporated in, one or more application-specific integrated circuits (ASICs) and/or one or more field programmable gate arrays (FPGAs).

Data storage device 1512 and memory 1510 each include a tangible non-transitory computer readable storage medium. Data storage device 1512, and memory 1510, may each include high-speed random access memory, such as dynamic random access memory (DRAM), static random access memory (SRAM), double data rate synchronous dynamic random access memory (DDR RAM), or other random access solid state memory devices, and may include non-volatile memory, such as one or more magnetic disk storage devices such as internal hard disks and removable disks, magneto-optical disk storage devices, optical disk storage devices, flash memory devices, semiconductor memory devices, such as erasable programmable read-only memory (EPROM), electrically erasable programmable read-only memory (EEPROM), compact disc read-only memory (CD-ROM), digital versatile disc read-only memory (DVD-ROM) disks, or other non-volatile solid state storage devices.

Input/output devices 1508 may include peripherals, such as a printer, scanner, display screen, etc. For example, input/output devices 1508 may include a display device such as a cathode ray tube (CRT) or liquid crystal display (LCD) monitor for displaying information to the user, a keyboard, and a pointing device such as a mouse or a trackball by which the user can provide input to computer 1502.

One skilled in the art will recognize that an implementation of an actual computer or computer system may have other structures and may contain other components as well, and that FIG. 15 is a high level representation of some of the components of such a computer for illustrative purposes.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A method for adjusting a height of an implement mounted on a body of a vehicle as the vehicle travels over a terrain, the method comprising:

receiving sensor data from a set of sensors disposed on the vehicle;

determining a trajectory associated with the vehicle based on the received sensor data;

estimating a profile of the terrain based on the determined trajectory associated with the vehicle;

detecting a ditch in the terrain and determining compensation values for adjusting the height of the implement based on the estimated profile of the terrain to compensate for the detected ditch; and transmitting one or more control signals to one or more actuators for adjusting the height of the implement based on the determined compensation values, wherein transmitting one or more control signals to one or more actuators for adjusting the height of the implement based on the determined compensation value comprises:

combining initial error values for achieving a target terrain surface with the determined compensation values to generate final error values; and generating the one or more control signals for adjusting the height of the implement according to the final error values.

2. The method of claim 1, wherein determining a trajectory associated with the vehicle based on the received sensor data comprises:

determining a state of the body and a state of the implement based on the received sensor data;

mapping the state of the body and the state of the implement to a one dimensional space to determine a state of the vehicle; and determining the trajectory associated with the vehicle based on the state of the vehicle.

3. The method of claim 2, wherein determining a state of the body and a state of the implement based on the received sensor data comprises:

determining a position and an orientation of the body and the implement and a linear velocity and an angular velocity associated with each axis of the position and the orientation of the body and the implement.

4. The method of claim 1, wherein estimating a profile of the terrain based on the determined trajectory associated with the vehicle comprises:

determining a pitch associated with the body based on the determined trajectory associated with the vehicle.

5. The method of claim 1, wherein detecting a ditch in the terrain and determining a compensation value for adjusting the height of the implement based on the estimated profile of the terrain to compensate for the detected ditch comprises:

computing a first derivative of the estimated profile of the terrain;

determining that the first derivative of the estimated profile of the terrain for a current point is a zero crossing; and comparing a magnitude of the estimated profile of the terrain for the current point to a magnitude of the estimated profile of the terrain for a last point determined to be a zero crossing.

6. The method of claim 5, wherein detecting a ditch in the terrain and determining a compensation value for adjusting the height of the implement based on the estimated profile of the terrain to compensate for the detected ditch further comprises:

determining a range of points between the current point and a last point determined to be a hump in the estimated profile of the terrain; and determining the compensation value for each point in the range of points based on a shape characteristic and a differential magnitude of the estimated profile of the terrain at the current point and the last point determined to be the hump.

7. The method of claim 6, wherein the shape characteristics comprises a step shape characteristic, a logarithmic shape characteristic, a quadratic shape characteristic, a ramp shape characteristic, an exponential shape characteristic, or a combination thereof.

8. The method of claim 1, wherein the vehicle comprises a dozer machine and the implement of the vehicle comprises a blade.

9. A non-transitory computer readable medium storing computer program instructions for adjusting a height of an implement mounted on a body of a vehicle as the vehicle travels over a terrain, the computer program instructions when executed by a processor cause the processor to perform operations comprising:

receiving sensor data from a set of sensors disposed on the vehicle;

determining a trajectory associated with the vehicle based on the received sensor data;

estimating a profile of the terrain based on the determined trajectory associated with the vehicle;

detecting a ditch in the terrain and determining compensation values for adjusting the height of the implement based on the estimated profile of the terrain to compensate for the detected ditch; and transmitting one or more control signals to one or more actuators for adjusting the height of the implement based on the determined compensation values, wherein transmitting one or more control signals to one or more actuators for adjusting the height of the implement based on the determined compensation value comprises:

combining initial error values for achieving a target terrain surface with the determined compensation values to generate final error values; and generating the one or more control signals for adjusting the height of the implement according to the final error values.

10. The non-transitory computer readable medium of claim 9, wherein determining a trajectory associated with the vehicle based on the received sensor data comprises:

determining a state of the body and a state of the implement based on the received sensor data;

mapping the state of the body and the state of the implement to a one dimensional space to determine a state of the vehicle; and determining the trajectory associated with the vehicle based on the state of the vehicle.

11. The non-transitory computer readable medium of claim 10, wherein determining a state of the body and a state of the implement based on the received sensor data comprises:

determining a position and an orientation of the body and the implement and a linear velocity and an angular velocity associated with each axis of the position and the orientation of the body and the implement.

12. The non-transitory computer readable medium of claim 9, wherein estimating a profile of the terrain based on the determined trajectory associated with the vehicle comprises:

determining a pitch associated with the body based on the determined trajectory associated with the vehicle.

13. The non-transitory computer readable medium of claim 9, wherein detecting a ditch in the terrain and determining a compensation value for adjusting the height of the implement based on the estimated profile of the terrain to compensate for the detected ditch comprises:

computing a first derivative of the estimated profile of the terrain;

determining that the first derivative of the estimated profile of the terrain for a current point is a zero crossing; and comparing a magnitude of the estimated profile of the terrain for the current point to a magnitude of the estimated profile of the terrain for a last point determined to be a zero crossing.

14. The non-transitory computer readable medium of claim 13, wherein detecting a ditch in the terrain and determining a compensation value for adjusting the height of the implement based on the estimated profile of the terrain to compensate for the detected ditch further comprises:

determining a range of points between the current point and a last point determined to be a hump in the estimated profile of the terrain; and determining the compensation value for each point in the range of points based on a shape characteristic and a differential magnitude of the estimated profile of the terrain at the current point and the last point determined to be the hump.

15. The non-transitory computer readable medium of claim 14, wherein the shape characteristics comprises a step shape characteristic, a logarithmic shape characteristic, a quadratic shape characteristic, a ramp shape characteristic, an exponential shape characteristic, or a combination thereof.

16. A controller comprising:

a processor; and a memory to store computer program instructions for adjusting a height of an implement mounted on a body of a vehicle as the vehicle travels over a terrain, the computer program instructions when executed on the processor cause the processor to perform operations comprising:

receiving sensor data from a set of sensors disposed on the vehicle;

determining a trajectory associated with the vehicle based on the received sensor data;

estimating a profile of the terrain based on the determined trajectory associated with the vehicle;

detecting a ditch in the terrain and determining compensation values for adjusting the height of the implement based on the estimated profile of the terrain to compensate for the detected ditch; and transmitting one or more control signals to one or more actuators for adjusting the height of the implement based on the determined compensation values, wherein transmitting one or more control signals to one or more actuators for adjusting the height of the implement based on the determined compensation value comprises:

combining initial error values for achieving a target terrain surface with the determined compensation values to generate final error values; and generating the one or more control signals for adjusting the height of the implement according to the final error values.

17. The controller of claim 16, wherein detecting a ditch in the terrain and determining a compensation value for adjusting the height of the implement based on the estimated profile of the terrain to compensate for the detected ditch comprises:

computing a first derivative of the estimated profile of the terrain;

determining that the first derivative of the estimated profile of the terrain for a current point is a zero crossing; and comparing a magnitude of the estimated profile of the terrain for the current point to a magnitude of the estimated profile of the terrain for a last point determined to be a zero crossing.

18. The controller of claim 17, wherein detecting a ditch in the terrain and determining a compensation value for adjusting the height of the implement based on the estimated profile of the terrain to compensate for the detected ditch further comprises:

determining a range of points between the current point and a last point determined to be a hump in the estimated profile of the terrain; and determining the compensation value for each point in the range of points based on a shape characteristic and a differential magnitude of the estimated profile of the terrain at the current point and the last point determined to be the hump.

19. The controller of claim 18, wherein the shape characteristics comprises a step shape characteristic, a logarithmic shape characteristic, a quadratic shape characteristic, a ramp shape characteristic, an exponential shape characteristic, or a combination thereof.

20. The controller of claim 16, wherein the vehicle comprises a dozer machine and the implement of the vehicle comprises a blade.

21. A vehicle comprising:

a body;

an implement coupled to the body;

one or more actuators coupled to the body and the implement;

a set of sensors disposed on the vehicle for generating sensor data as the vehicle travels over a terrain; and a controller for:

receiving the sensor data;

determining a trajectory associated with the vehicle based on the received sensor data;

estimating a profile of the terrain based on the determined trajectory associated with the vehicle;

detecting a ditch in the terrain and determining compensation values for adjusting a height of the implement based on the estimated profile of the terrain to compensate for the detected ditch; and transmitting one or more control signals to the one or more actuators for adjusting the height of the implement based on the determined compensation values, wherein transmitting one or more control signals to one or more actuators for adjusting the height of the implement based on the determined compensation value comprises:

combining initial error values for achieving a target terrain surface with the determined compensation values to generate final error values; and generating the one or more control signals for adjusting the height of the implement according to the final error values.

22. The vehicle of claim 21, wherein determining a trajectory associated with the vehicle based on the received sensor data comprises:

determining a state of the body and a state of the implement based on the received sensor data;

mapping the state of the body and the state of the implement to a one dimensional space to determine a state of the vehicle; and determining the trajectory associated with the vehicle based on the state of the vehicle.

23. The vehicle of claim 22, wherein determining a state of the body and a state of the implement based on the received sensor data comprises:

determining a position and an orientation of the body and the implement and a linear velocity and an angular velocity associated with each axis of the position and the orientation of the body and the implement.

24. The vehicle of claim 21, wherein estimating a profile of the terrain based on the determined trajectory associated with the vehicle comprises:

determining a pitch associated with the body based on the determined trajectory associated with the vehicle.

25. The vehicle of claim 21, wherein detecting a ditch in the terrain and determining compensation values for adjusting a height of the implement based on the estimated profile of the terrain to compensate for the detected ditch comprises:

computing a first derivative of the estimated profile of the terrain;

determining that the first derivative of the estimated profile of the terrain for a current point is a zero crossing; and comparing a magnitude of the estimated profile of the terrain for the current point to a magnitude of the estimated profile of the terrain for a last point determined to be a zero crossing.

26. The vehicle of claim 25, wherein detecting a ditch in the terrain and determining compensation values for adjusting a height of the implement based on the estimated profile of the terrain to compensate for the detected ditch further comprises:

determining a range of points between the current point and a last point determined to be a hump in the estimated profile of the terrain; and determining the compensation value for each point in the range of points based on a shape characteristic and a differential magnitude of the estimated profile of the terrain at the current point and the last point determined to be the hump.

27. The vehicle of claim 26, wherein the shape characteristics comprises a step shape characteristic, a logarithmic shape characteristic, a quadratic shape characteristic, a ramp shape characteristic, an exponential shape characteristic, or a combination thereof.

28. The vehicle of claim 21, wherein the vehicle comprises a dozer machine and the implement comprises a blade.

* * * * *